US010934761B2

(12) United States Patent
Cavarec et al.

(10) Patent No.: US 10,934,761 B2
(45) Date of Patent: Mar. 2, 2021

(54) SLIDING WINDOW FOR A BUILDING, HOME AUTOMATION INSTALLATION COMPRISING SUCH A SLIDING WINDOW AND METHOD FOR CONTROLLING THE OPERATION OF A MOTORIZED DRIVE DEVICE FOR SUCH A WINDOW

(71) Applicants: SOMFY ACTIVITES SA, Cluses (FR); Groupe LIEBOT, Les Herbiers (FR)

(72) Inventors: Pierre-Emmanuel Cavarec, Mont Saxonnex (FR); Marc Brechemier, Canet en Roussillon (FR); David Serve, La Roche sur Yon (FR); Christophe Jacquin, Samoens (FR); Stéphane Beau, Mieussy (FR); Julien Cron, Sallanches (FR)

(73) Assignees: SOMFY ACTIVITES SA, Cluses (FR); GROUPE LIEBOT, Les Herbiers (FR)

( * ) Notice: Subject to any disclaimer, the term of this patent is extended or adjusted under 35 U.S.C. 154(b) by 0 days.

(21) Appl. No.: 16/479,754

(22) PCT Filed: Dec. 15, 2017

(86) PCT No.: PCT/EP2017/083152
§ 371 (c)(1),
(2) Date: Jul. 22, 2019

(87) PCT Pub. No.: WO2018/134008
PCT Pub. Date: Jul. 26, 2018

(65) Prior Publication Data

US 2019/0360254 A1 Nov. 28, 2019

(30) Foreign Application Priority Data

Jan. 23, 2017 (FR) ..... 1750522

(51) Int. Cl.
*E05F 11/00* (2006.01)
*E05F 15/643* (2015.01)
*E05D 15/56* (2006.01)

(52) U.S. Cl.
CPC ..... *E05F 15/643* (2015.01); *E05D 15/565* (2013.01); *E05Y 2201/22* (2013.01);
(Continued)

(58) Field of Classification Search
CPC .. E05F 15/643; E05D 15/565; E05Y 2201/22; E05Y 2201/24; E05Y 2201/434;
(Continued)

(56) References Cited

U.S. PATENT DOCUMENTS 4,541,202 A * 9/1985 Dockery ..... E05F 15/635 49/362
5,301,734 A * 4/1994 Opel ..... E05D 15/22 160/100
(Continued)

FOREIGN PATENT DOCUMENTS

EP 0 509 128 10/1992
EP 1 076 148 2/2001
(Continued)

OTHER PUBLICATIONS

International Search Report, PCT/EP2017/083152, dated Apr. 12, 2018.

*Primary Examiner* — Jerry E Redman
(74) *Attorney, Agent, or Firm* — Nixon & Vanderhye

(57) ABSTRACT

A sliding window for a building includes a stationary frame, an opening leaf, a motorized drive device, a fittings system, and a locking control device. The motorized drive device includes an electromechanical actuator, a flexible element, and a drive arm. The flexible element drives movement of the opening leaf with respect to the stationary frame when
(Continued)

the actuator is electrically activated. The arm is connected both to a frame of the opening leaf and to the flexible element. The locking control device collaborates with a lock of the fittings system and is actuated by the flexible element when the actuator is electrically activated. The drive arm supports the locking control device. The fittings system also includes an errorproofing system. The locking control device actuates the lock following activation of the errorproofing system and when the actuator is electrically activated.

20 Claims, 7 Drawing Sheets

(52) U.S. Cl.
CPC ..... *E05Y 2201/24* (2013.01); *E05Y 2201/434* (2013.01); *E05Y 2201/604* (2013.01); *E05Y 2900/148* (2013.01)

(58) Field of Classification Search
CPC ..... E05Y 2201/604; E05Y 2201/606; E05Y 2201/652; E05Y 2900/148; E05Y 2600/41; E05Y 2600/45; E05Y 2800/426
USPC ..... 49/360
See application file for complete search history.

(56) References Cited

U.S. PATENT DOCUMENTS 5,355,624 A * 10/1994 Bacon ..... E05F 15/635 49/280
5,634,298 A * 6/1997 Slopack ..... E05F 15/75 49/360
6,530,176 B1 3/2003 Hein
6,585,303 B1 * 7/2003 Coose ..... E05B 47/0012 292/144
6,658,793 B2 * 12/2003 Perron ..... E05F 11/04 49/123
6,918,210 B1 * 7/2005 Smiley ..... E05F 15/643 49/347
9,038,317 B2 * 5/2015 Hansen ..... E05F 15/665 49/360
9,290,977 B2 * 3/2016 Haab ..... E05D 15/0652
9,885,207 B2 * 2/2018 Ando ..... E05F 15/635
2004/0244295 A1 * 12/2004 Derham ..... E05F 15/41 49/362
2005/0284026 A1 * 12/2005 DuBose ..... E05F 11/36 49/360
2011/0041408 A1 * 2/2011 Lopez Saez ..... B60J 5/062 49/260
2012/0023827 A1 * 2/2012 Hancock ..... E05F 15/77 49/360
2012/0167469 A1 * 7/2012 Maltaverne ..... B60J 1/16 49/360
2013/0276373 A1 * 10/2013 Haab ..... E05F 15/603 49/360
2014/0041305 A1 * 2/2014 Gazda ..... E05F 15/643 49/360
2014/0047770 A1 * 2/2014 Vaknin ..... E05F 15/643 49/349
2019/0249478 A1 * 8/2019 Eichler ..... E05C 17/62
2019/0309562 A1 * 10/2019 Hall ..... E05F 15/71
2019/0360254 A1 * 11/2019 Cavarec ..... E05F 15/643

FOREIGN PATENT DOCUMENTS

EP 1 507 059 2/2005
JP S58-20075 U 2/1983
JP 2613629 B 5/1997
JP H11-166355 A 6/1999

* cited by examiner

SLIDING WINDOW FOR A BUILDING, HOME AUTOMATION INSTALLATION COMPRISING SUCH A SLIDING WINDOW AND METHOD FOR CONTROLLING THE OPERATION OF A MOTORIZED DRIVE DEVICE FOR SUCH A WINDOW

BACKGROUND OF THE INVENTION

Field of the Invention

The present invention relates to a sliding window for a building comprising a motorized drive device for moving an opening leaf relative to a stationary frame in a sliding movement.

The present invention also relates to a home automation facility comprising such a sliding window.

The present invention lastly relates to a method for controlling the operation of a motorized drive device of such a sliding window for a building.

In general, the present invention relates to the field of windows comprising a motorized drive device setting an opening leaf in motion relative to a stationary frame in a sliding movement, between at least one first position and at least one second position.

A motorized drive device of such a window comprises an electromechanical actuator.

Description of the Related Art

Already known is document EP 1,507,059 A2, which describes a sliding window for a building comprising a stationary frame, an opening leaf and a motorized drive device for moving the opening leaf by sliding relative to the stationary frame. The motorized drive device comprises an electromechanical actuator, a flexible element and a drive arm. The electromechanical actuator comprises an electric motor. The flexible element is moved by the electrochemical actuator. The flexible element is configured to drive the movement of the opening leaf relative to the stationary frame, when the electromechanical actuator is electrically activated. The drive arm is connected, on the one hand, to a lateral upright of a frame of the opening leaf and, on the other hand, to the flexible element. The window also comprises a fittings system and a locking control device. The fittings system comprises a latch. The locking control device is configured to cooperate with the latch and to be actuated using the flexible element, when the electromechanical actuator is electrically activated.

The drive arm is rotatable about a rotation axis belonging to a lateral upright of a frame of the opening leaf. This lateral upright of the frame of the opening leaf is configured to cooperate with the stationary frame in a closed position of the opening leaf relative to the stationary frame.

However, the mechanism formed by the motorized drive device, the fittings system and the locking control device of the sliding window has the drawback of requiring ample travel to allow the movement, as well as the locking, of the opening leaf relative to the stationary frame.

Furthermore, the cost of obtaining the sliding window is high, due to the number of parts making up such a mechanism and the complexity of industrialization.

Furthermore, such a mechanism is not very esthetically pleasing due to its bulk.

Such a mechanism further requires adjusting a locking position of the opening leaf relative to the stationary frame, such that the latter corresponds to the closed position of the opening leaf relative to the stationary frame.

Also known is document EP 0,509,128 A1, which describes a sliding door. The sliding door comprises a stationary frame, an opening leaf, a motorized drive device for moving the leaf by sliding relative to the frame. The motorized drive device comprises an electromechanical actuator, a flexible element and a drive arm. The flexible element is configured to drive the movement of the opening leaf relative to the stationary frame, when the electromechanical actuator is electrically activated. The drive arm is connected, on the one hand, to the opening leaf and, on the other hand, to the flexible element. Furthermore, the sliding door comprises a latch and a locking control device. The locking control device is configured to cooperate with the latch and to be actuated using the flexible element, when the electromechanical actuator is electrically activated. Moreover, the drive arm supports the locking control device. The sliding door comprises an error-proofing system.

BRIEF SUMMARY OF THE INVENTION

The present invention aims to resolve the aforementioned drawbacks and to propose a sliding window for a building comprising a motorized drive device for moving an opening leaf relative to a stationary frame in a sliding movement, a fittings system and a locking control device of the opening leaf relative to the stationary frame, a home automation facility comprising such a sliding window, as well as a method for controlling the operation of a motorized drive device of such a sliding window for a building, making it possible to simplify the industrialization of the locking control device, to guarantee tightness in a closed and locked position of the opening leaf relative to the stationary frame, while minimizing the costs of obtaining the window.

To that end, according to a first aspect, the present invention relates to a sliding window for a building comprising:

- a stationary frame, at least one opening leaf, a motorized drive device for moving the opening leaf by sliding relative to the stationary frame,
  - the motorized drive device comprising:
    - an electromechanical actuator, the electromechanical actuator comprising an electric motor,
    - a flexible element, the flexible element being configured to drive the movement of the opening leaf relative to the stationary frame, when the electromechanical actuator is electrically activated,
    - a drive arm, the drive arm being connected, on the one hand, to a frame of the opening leaf and, on the other hand, to the flexible element,
- a fittings system, the fittings system comprising a latch,
- a locking control device,
  - the locking control device being configured to:
    - cooperate with the latch, and
    - be actuated using the flexible element, when the electromechanical actuator is electrically activated.

According to the invention, the drive arm supports the locking control device. The fittings system also comprises an error-proofing system and a window catch. The error-proofing system comprises a retractable pin, the retractable pin being configured to be moved between an idle position, in which the window catch is blocked, and an activated position, in which the window catch is released. The error-proofing system is activated when the retractable pin is pushed inside a housing arranged in the frame of the opening leaf. Furthermore, the locking control device is configured to actuate the latch, after the activation of the error-proofing system and when the electromechanical actuator is electrically activated.

Thus, the arrangement formed by the motorized drive device, the fittings system and the locking control device of the sliding window makes it possible to simplify the industrialization of the locking control device, to guarantee tightness in a closed and locked position of the opening leaf relative to the stationary frame, while minimizing the costs of obtaining the window.

In this way, such an arrangement of the window makes it possible to lock and unlock the first opening leaf relative to the stationary frame by means of the fittings system, without modifying a sealing gasket configured to cooperate with the first opening leaf and the stationary frame, when the closed position of the first opening leaf is reached relative to the stationary frame, while maintaining the traditional window placement techniques, in particular for adjusting fittings systems.

Furthermore, this arrangement of the window makes it possible to use a fittings system comprising standard elements, in particular the latch having standard characteristics.

In this way, the latch can be provided without any particular reinforcement, so as to minimize the costs of obtaining the window and to guarantee the compatibility of the locking control device with existing components for the fittings systems.

Furthermore, the latch is associated with the drive arm by means of the locking control device, so as to secure the opening leaf to the motorized drive device provided with a flexible element.

In this way, the movement transmitted by the motorized drive device along a linear direction is converted into a rotational movement at the latch by means of the locking control device.

According to one preferred feature of the invention, the locking control device comprises an actuating mechanism of the latch configured to rotate a shaft of the latch, during driving of the flexible element by the electromechanical actuator.

According to one example embodiment of the invention, the actuating mechanism of the latch comprises at least one lever arm.

In a variant, the actuating mechanism of the latch comprises an additional flexible element.

In a variant, the actuating mechanism of the latch comprises a gear.

According to one advantageous feature of the invention, the locking control device comprises a transmission element connected to the shaft of the latch.

According to another advantageous feature of the invention, the drive arm is stationary relative to the frame of the opening leaf.

According to another preferred feature of the invention, the drive arm and the latch of the fittings system are arranged in the upper part of the lateral upright of the frame of the opening leaf, in the assembled configuration of the window relative to the building.

According to another advantageous feature of the invention, the locking control device comprises a drive element. The drive element is connected to the flexible element. Furthermore, at least part of the drive element is mounted rotatably relative to the drive arm, around a rotation axis.

According to another advantageous feature of the invention, the drive element comprises a transmission arm. Furthermore, the transmission arm comprises, at one of its ends, a rack.

According to another advantageous feature of the invention, the connection of the flexible element to the drive element is done using a shuttle. Furthermore, the shuttle comprises a pin configured to cooperate with a slot of the transmission arm.

According to another advantageous feature of the invention, the transmission element and the drive element are an integral part of the actuating mechanism of the latch. The transmission element is a toothed wheel. The toothed wheel is configured to be assembled on the shaft of the latch. Furthermore, the rack of the transmission arm is configured to cooperate with the toothed wheel, in an assembled configuration of the locking control device.

According to another advantageous feature of the invention, the drive element comprises a first part and a second part. The first part of the drive element comprises a first gear segment configured to cooperate with a second gear segment of the second part of the drive element, in an assembled configuration of the locking control device.

Furthermore, the second part of the drive element comprises at least a first guide element configured to cooperate with a second guide element arranged at the drive arm.

According to another advantageous feature of the invention, the electromechanical actuator is reversible.

According to a second aspect, the present invention relates to a home automation facility comprising a sliding window according to the invention.

This home automation facility has features and advantages similar to those previously described, relative to the sliding window according to the invention.

According to a third aspect, the present invention relates to a method for controlling the operation of a motorized drive device of a sliding window for a building, as mentioned above.

According to the invention, the drive arm supports the locking control device. The fittings system also comprises an error-proofing system and a window catch. The error-proofing system comprises a retractable pin, the retractable pin being configured to be moved between an idle position, in which the window catch is blocked, and an activated position, in which the window catch is released. The error-proofing system is activated when the retractable pin is pushed inside a housing arranged in the frame of the opening leaf. The method comprises at least the following steps, carried out during the electrical activation of the electromechanical actuator:

activation of the error-proofing system, then activation of the latch using the locking control device.

Other particularities and advantages of the invention will also appear in the description below.

BRIEF DESCRIPTION OF THE DRAWINGS

In the appended drawings, provided as non-limiting examples.

DETAILED DESCRIPTION OF THE PREFERRED EMBODIMENTS

First described, in reference to FIGS. 1 to 5, is a home automation facility according to the invention and installed in a building including an opening 1, in which a sliding window 2, according to a first embodiment of the invention, is arranged.

The sliding window 2 can also be called sliding pocket.

The present invention applies to sliding windows and sliding patio doors, which may or may not be equipped with transparent glazing.

The window 2 comprises at least one opening leaf 3*a*, 3*b* and a stationary frame 4.

Figure 1:
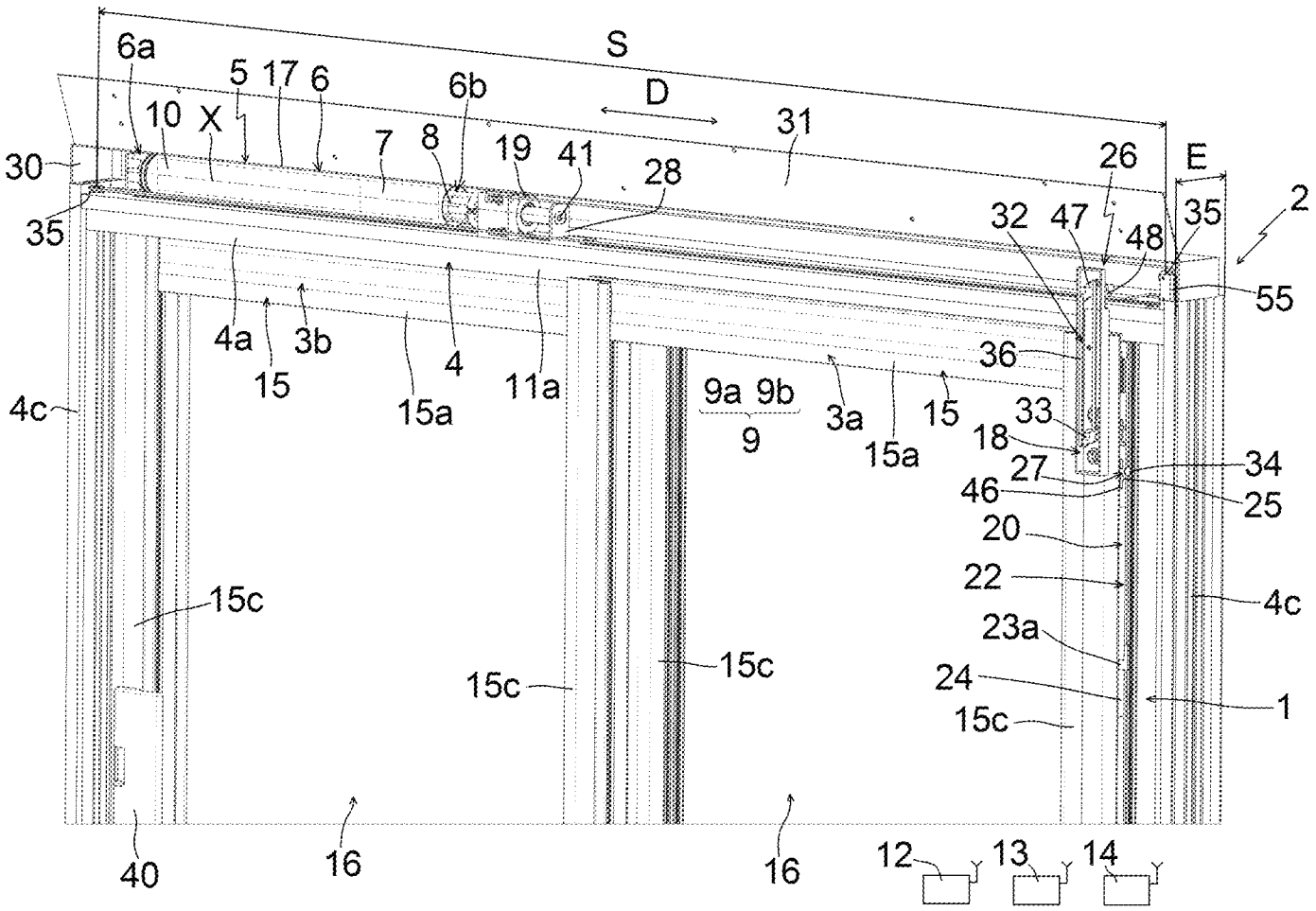
FIG. 1 is a partial schematic perspective view of the sliding window according to a first embodiment of the invention, where a first opening leaf is in a partial open position relative to a stationary frame, where an access hatch for a box housing a motorized drive device is in the open position and where a front wall of the drive arm of the motorized drive device has been removed, to make the figure easier to read.
Figure 2:
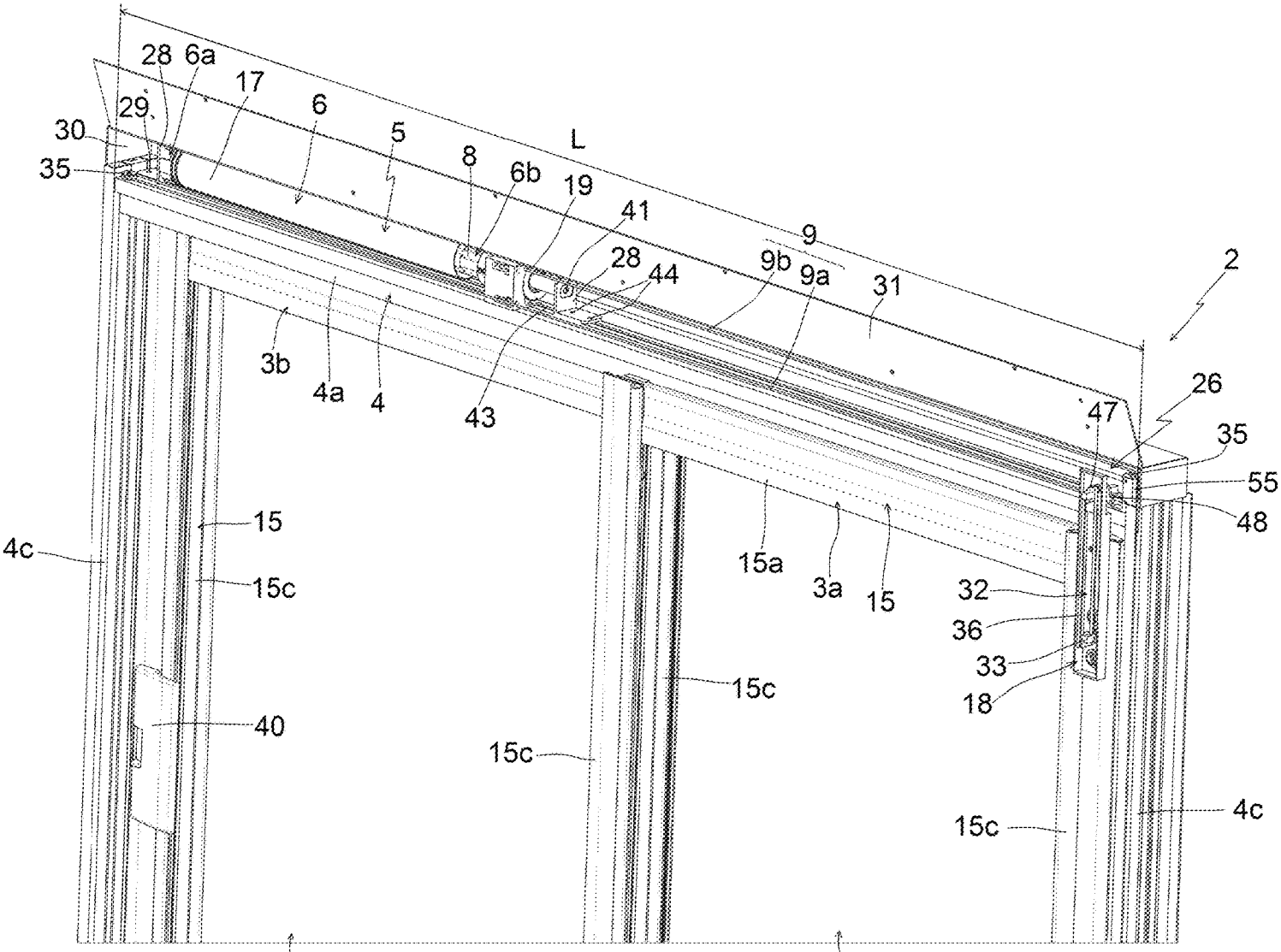
FIG. 2 is a view similar to FIG. 1, from a different viewing angle, where the opening leaf is in a closed position relative to the stationary frame.

Here, and as illustrated in FIGS. 1 and 2, the window 2 comprises a first opening leaf 3*a* and a second opening leaf 3*b*.

The window 2 also comprises a motorized drive device 5 for moving an opening leaf 3*a* by sliding relative to the stationary frame 4.

Here, the motorized drive device 5 is configured to move only one of the first and second opening leaves 3*a*, 3*b* by sliding relative to the stationary frame 4, in particular the first opening leaf 3*a*.

Here, and as illustrated in FIGS. 1 and 2, the second opening leaf 3*b* is movable manually, in particular by the action of a user exerting a force on the handle 40 of the second opening leaf 3*b*.

Alternatively, the second opening leaf 3*b* is stationary.

The number of opening leaves of the window is not limiting and can be different, in particular equal to three.

Each opening leaf 3*a*, 3*b* comprises a frame 15. Each opening leaf 3*a*, 3*b* may also comprise at least one glass sheet 16 arranged in the frame 15.

The number of glass sheets of the opening leaf is not limiting and can be different, in particular equal to two or more.

The frame 15 of each opening leaf 3*a*, 3*b* includes an upper crosspiece 15*a*, a lower crosspiece, not shown, and first and second lateral uprights 15*c*, in the assembled configuration of the window 2 relative to the building, as illustrated in FIGS. 1 and 2.

Here and as illustrated in FIGS. 1 and 2, the first lateral upright 15*c* of the frame 15 of the first opening leaf 3*a* is the lateral upright 15*c* located to the right of the first opening leaf 3*a*. Furthermore, the second lateral upright 15*c* of the frame 15 of the first opening leaf 3*a* is the lateral upright 15*c* located to the left of the first opening leaf 3*a*.

The first lateral upright 15*c* of the frame 15 of the first opening leaf 3*a* is opposite the second lateral upright 15*c* of the frame 15 of the first opening leaf 3*a*.

The stationary frame 4 includes an upper crosspiece 4*a*, a lower crosspiece, not shown, and first and second lateral uprights 4*c*, in the assembled configuration of the window 2 relative to the building, as illustrated in FIGS. 1 and 2.

Here and as illustrated in FIGS. 1 and 2, the first lateral upright 4*c* of the stationary frame 4 is the lateral upright 4*c* located to the right of the stationary frame 4. Furthermore, the second lateral upright 4*c* of the stationary frame 4 is the lateral upright 4*c* located to the left of the stationary frame 4.

The first lateral upright 4*c* of the stationary frame 4 is opposite the second lateral upright 4*c* of the stationary frame 4.

The upper crosspiece 4*a*, the lower crosspiece and the two lateral uprights 4*c* of the stationary frame 4 respectively have an inner face and at least one outer face.

The inner faces of the upper crosspiece 4*a*, the lower crosspiece and the two lateral uprights 4*c* of the stationary frame 4 are oriented toward the inside of the window 2, and in particular toward an outer rim of the frame 15 of each opening leaf 3*a*, 3*b*.

The outer faces of the upper crosspiece 4*a*, the lower crosspiece and the two lateral uprights 4*c* of the stationary frame 4 are oriented toward the outside of the window 2.

The window 2 also comprises a fittings system 20 arranged between the stationary frame 4 and each opening leaf 3*a*, 3*b*.

The fittings system 20 of the sliding window 2 makes it possible to slide each opening leaf 3*a*, 3*b* relative to the stationary frame 4 along a sliding direction D, in the example horizontal, in the assembled configuration of the window 2 relative to the building, as illustrated in FIGS. 1 and 2.

The upper crosspiece 4*a* of the stationary frame 4 comprises a sliding rail 11*a* of the first opening leaf 3*a* and a sliding rail, not shown, of the second opening leaf 3*b*. The lower crosspiece of the stationary frame 4 also comprises two sliding rails, respectively for the first opening leaf 3*a* and the second opening leaf 3*b*.

Thus, each of the upper 4*a* and lower crosspieces of the stationary frame 4 comprises a first sliding rail 11*a* or equivalent of the first opening leaf 3 and a second sliding rail or the like of the second opening leaf 3*b*.

In this way, the first and second opening leaves 3*a*, 3*b* are configured to move respectively along first and second sliding rails 11*a* and the like.

In practice, the first and second sliding rails 11*a* and the like are arranged parallel to one another. Furthermore, the first and second sliding rails 11*a* and the like are offset relative to one another along the thickness E of the stationary frame 4.

The window 2 comprises sliding elements, not shown, allowing the movement of each opening leaf 3*a*, 3*b* relative to the stationary frame 4. The sliding elements are arranged inside the first and second sliding rails of the lower crosspiece.

In practice, the sliding elements comprise casters arranged below the first and second opening leaves 3*a*, 3*b*. The casters are configured to roll inside the first and second sliding rails of the lower crosspiece.

An open position by partial or maximal sliding of each opening leaf 3*a*, 3*b* relative to the stationary frame 4 corresponds to an aeration position of the building.

The motorized drive device 5 makes it possible to move the first opening leaf 3*a*, automatically by sliding, relative to the stationary frame 4, in particular between the maximum opening position by sliding of the first opening leaf 3*a* relative to the stationary frame 4 and the closed position of the first opening leaf 3*a* relative to the stationary frame 4.

The motorized drive device 5 comprises an electromechanical actuator 6. The electromechanical actuator 6 comprises an electric motor 7 and an output shaft 8.

Here, the rotation axis X of the output shaft 8 is parallel to the sliding direction D of the first opening leaf 3*a* relative to the stationary frame 4 and, in the present case, the second opening leaf 3*b* relative to the stationary frame 4.

The electromechanical actuator 6 is arranged on a stationary part relative to the window 2, in particular relative to the stationary frame 4.

The electromechanical actuator 6 may also comprise a gear reduction device, not shown.

The electromechanical actuator 6 may also comprise an end-of-travel and/or obstacle detection device, not shown. This detection device may be mechanical or electronic.

Advantageously, the electric motor 7 and, optionally, the reducing gear device are positioned inside a casing 17 of the electromechanical actuator 6.

Here, the electromechanical actuator 6 is of the tubular type.

The motorized drive device 5 also comprises a flexible element 9. The flexible element 9 is moved by the electrochemical actuator 6.

The flexible element 9 is configured to drive the movement of the first opening leaf 3*a* relative to the stationary frame 4, when the electromechanical actuator 6 is electrically activated.

Here, the flexible element 9 comprises a first strand 9*a* and a second strand 9*b*.

The flexible element 9 may have a circular section.

The section of the flexible element is not limiting and may be different, in particular square, rectangular or oval.

In practice, the flexible element 9 is a cable or a cord.

It may be made from a synthetic material, for example nylon or polyethylene with a very high molar mass.

Thus, the use of a flexible element 9 made from a synthetic material makes it possible to minimize the diameter of pulleys of the motorized drive device 5.

The material of the flexible element is not limiting and may be different. In particular, it may be a steel.

Figure 3:
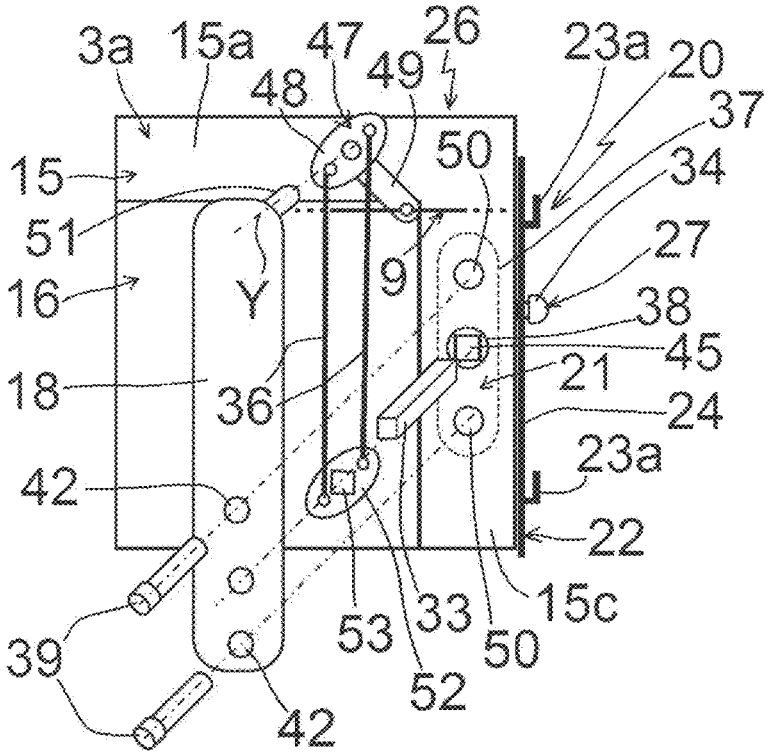
FIG. 3 is an exploded perspective schematic view of part of the sliding window illustrated in FIGS. 1 and 2, illustrating a locking control device according to the first embodiment.

The motorized drive device 5 comprises a drive arm 18 illustrated in FIGS. 1 to 3. The drive arm 18 is, on the one hand, attached on the first opening leaf 3*a* and, on the other hand, connected to the flexible element 9.

Thus, the drive arm 18 is configured to secure the flexible element 9 to the first opening leaf 3*a*.

Here, the drive arm 18 is attached directly on the first opening leaf 3*a*.

In a variant, not shown, the drive arm 18 is attached to the first opening leaf 3*a* using an intermediate element. Preferably, the intermediate element is a guide element, in particular a crosshead, along the sliding direction D.

Advantageously, the flexible element 9 is connected to the drive arm 18, irrespective of the state of the locking elements of the fittings system 20, i.e., both in the locked state and the unlocked state of the first opening leaf 3*a* relative to the stationary frame 4.

Thus, the flexible element 9 is connected to the drive arm 18 permanently, in the assembled configuration of the motorized drive device 5 on the window 2.

In this way, the connection between the flexible element 9 and the drive arm 18 is simplified and makes it possible to minimize the costs of obtaining the window 2.

In the example illustrated in FIGS. 1 and 2, the motorized drive device 5 comprises a winding pulley 19 of the flexible element 9. The winding pulley 19 is rotated by the output shaft 8 of the electromechanical actuator 6.

A first end of the first strand 9*a* of the flexible element 9 is connected to a first part of the winding pulley 19. A first end of the second strand 9*b* of the flexible element 9 is connected to a second part of the winding pulley 19, as illustrated in FIGS. 1 and 2.

Advantageously, the first end of each of the first and second strands 9*a*, 9*b* of the flexible element 9 is respectively attached to the first part or to the second part of the winding pulley 19 using fasteners, not shown.

Thus, the first end of each of the first and second strands 9*a*, 9*b* of the flexible element 9 is respectively fastened directly to the first part or to the second part of the winding pulley 19.

In practice, the fasteners of the end of each of the first and second strands 9*a*, 9*b* of the flexible element 9 are cable-clamp elements.

Here, these fasteners are screws, in particular of the self-tapping type, screwing into the winding pulley 19, so as to fasten the first and second strands 9*a*, 9*b* of the flexible element 9 by jamming between the head of the screws and the winding surface of the flexible element 9 of the winding pulley 19.

Here, the winding, respectively unwinding, direction of the first strand 9*a* of the flexible element 9 around the first part of the winding pulley 19 is opposite the winding, respectively unwinding, direction of the second strand 9*b* of the flexible element 9 around the second part of the winding pulley 19.

Thus, during the movement of the first opening leaf 3*a* relative to the stationary frame 4 in a first sliding direction, in particular during the movement from the closed position toward an open position of the first opening leaf 3*a* relative to the stationary frame 4, the first strand 9*a* of the flexible element 9 winds around the first part of the winding pulley 19, while the second strand 9*b* of the flexible element 9 unwinds around the second part of the winding pulley 19.

Furthermore, during the movement of the first opening leaf 3*a* relative to the stationary frame 4 in a second sliding direction, in particular during the movement from an open position toward the closed position of the first opening leaf 3*a* relative to the stationary frame 4, the first strand 9*a* of the flexible element 9 unwinds around the first part of the winding pulley 19, while the second strand 9*b* of the flexible element 9 winds around the second part of the winding pulley 19.

The second sliding direction of the first opening leaf 3*a* relative to the stationary frame 4 is opposite the first sliding direction.

In this way, the rotational driving direction of the first strand 9*a* of the flexible element 9 around the first part of the winding pulley 19 is opposite the rotational driving direction of the second strand 9*b* of the flexible element 9 around the second part of the winding pulley 19.

Advantageously, the sliding direction of the first opening leaf 3*a* relative to the stationary frame 4 is determined based on the rotation direction of the output shaft 8 of the electromechanical actuator 6. Furthermore, the rotational driving direction of the winding pulley 19 is determined by the rotation direction of the output shaft 8 of the electromechanical actuator 6.

Thus, the rotational driving direction of the first strand 9*a* and the second strand 9*b* of the flexible element 9 around the first and second parts of the winding pulley 19 depends on the rotation direction of the output shaft 8 of the electromechanical actuator 6.

Here, the rotational driving direction of the winding pulley 19 is identical to the rotation direction of the output shaft 8 of the electromechanical actuator 6.

Control means of the electromechanical actuator 6 allow the sliding movement of the first opening leaf 3*a* relative to the stationary frame 4. These control means comprise at least one electronic control unit 10. The electronic control unit 10 is configured to operate the electric motor 7 of the electromechanical actuator 6 and, in particular, to allow the supply of electricity to the electric motor 7.

Thus, the electronic control unit 10, in particular, commands the electric motor 7, so as to open or close the first opening leaf 3*a* relative to the stationary frame 4 by sliding.

In this way, the window 2 comprises the electronic control unit 10. More particularly, the electronic control unit 10 is integrated into the motorized drive device 5.

Advantageously, the motorized drive device 5 is a subassembly preassembled before mounting, in the example on the stationary frame 4, which comprises at least the electromechanical actuator 6, the winding pulley 19, the flexible element 9 and the electronic control unit 10.

The motorized drive device 5 is controlled by a control unit. The control unit may for example be a local control unit 12.

The local control unit 12 may be connected through a wired or wireless connection with a central control unit 13. The central control unit 13 drives the local control unit 12, as well as other similar local control units distributed throughout the building.

The electronic control unit 10 also comprises an order receiving module, in particular radioelectric orders sent by an order transmitter, such as the local control unit 12 or the central control unit 13, said orders being intended to control the motorized drive device 5. The order receiving module can also allow the reception of orders sent by wired means.

The electronic control unit 10, the local control unit 12 and/or the central control unit 13 can be in communication with one or several sensors configured to determine, for example, a temperature, a hygrometry, a wind speed, a measurement of an indoor or outside air quality or a presence.

The central control unit 13 may also be in communication with a server 14, so as to control the electromechanical actuator 6 according to data made available remotely via a communication network, in particular an Internet network that may be connected to the server 14.

The electronic control unit 10 may be controlled from the local control unit 12. The local control unit 12 is provided with a control keyboard. The control keyboard of the local control unit 12 comprises selection elements and, optionally, display elements.

As non-limiting examples, the selection elements may be pushbuttons or sensitive keys, the display elements may be light-emitting diodes, an LCD (Liquid Crystal Display) or TFT (Thin Film Transistor) display. The selection and display elements may also be produced using a touch-sensitive screen.

The local control unit 12 may be a stationary or nomad control point. A stationary control point corresponds to a control unit intended to be attached on a façade of a wall of the building, on a face of the frame 15 of the first opening leaf 3*a* of the window 2 or on a face of the stationary frame 4 of the window 2. A nomad control point corresponds to a remote control.

The local control unit 12 allows direct control of the electronic control unit 10 based on a selection made by the user.

The local control unit 12 allows the user to intervene directly on the electromechanical actuator 6 of the motorized drive device 5 using the electronic control unit 10 associated with said motorized drive device 5, or to intervene indirectly on the electromechanical actuator 6 of the motorized drive device 5 using the central control unit 13.

The motorized drive device 5, in particular the electronic control unit 10, is, preferably, configured to carry out closing command orders by sliding as well as opening by sliding of the first opening leaf 3*a* relative to the stationary frame 4, said command orders being able to be emitted, in particular, by the local control unit 12 or by the central control unit 13.

The electronic control unit 10 is thus configured to operate the electromechanical actuator 6 of the motorized drive device 5 and, in particular, to allow the supply of electricity to the electromechanical actuator 6.

Here and as illustrated in FIG. 1, the electronic control unit 10 is positioned inside the casing 17 of the electromechanical actuator 6.

The control means of the electromechanical actuator 6 comprise hardware and/or software means.

As one non-limiting example, the hardware means may comprise at least one microcontroller.

Advantageously, the local control unit 12 comprises a sensor measuring at least one parameter of the environment inside the building and integrated into said unit.

Thus, the local control unit 12 can communicate with the central control unit 13, and the central control unit 13 can control the electronic control unit 10 associated with the motorized drive device 5 based on data coming from the sensor measuring the parameter of the environment inside the building.

Moreover, the local control unit 12 can directly control the electronic control unit 10 associated with the motorized drive device 5 based on data coming from the sensor measuring the parameter of the environment inside the building.

As non-limiting examples, one parameter of the environment inside the building measured by the sensor integrated into the local control unit 12 is the humidity, the temperature, the carbon dioxide level or the level of a volatile organic compound in the air.

Preferably, the activation of the local control unit 12 by the user has priority relative to the activation of the central control unit 13, so as to control the closing and opening by sliding of the first opening leaf 3*a* relative to the stationary frame 4.

Thus, the activation of the local control unit 12 directly controls the electronic control unit 10 associated with the motorized drive device 5 based on a selection made by the user, optionally inhibiting a control order that may be sent by the central control unit 13 or ignoring a value measured by a sensor measuring at least one parameter of the environment inside the building or outside the building, or a presence detection signal inside the building.

The motorized drive device 5 can be controlled by the user, for example by receiving a command order corresponding to pressing on a selection element of the local control unit 12, such as a remote control unit or a stationary control point.

The motorized drive device 5 can also be controlled automatically, for example by receiving a command order corresponding to at least one signal coming from at least one sensor and/or to a signal coming from a clock. The sensor and/or the clock can be integrated into the local control unit 12 or the central control unit 13.

Advantageously, the motorized drive device 5 makes it possible to move the first opening leaf 3*a* automatically by sliding relative to the stationary frame 4 to a predetermined position, between the closed position and the maximal opened position. The movement by sliding of the first opening leaf 3*a* relative to the stationary frame 4 to the predetermined position, in particular partial opening or closing, is carried out after receiving a command order emitted by the local control unit 12, the central control unit 13 or a sensor.

Here, a movement by sliding of the first opening leaf 3 relative to the stationary frame 4 in the sliding direction D is carried out by supplying electricity to the electromechanical actuator 6, so as to unwind or wind the first and second strands 9*a*, 9*b* of the flexible element 9 around the first and second parts of the winding pulley 19.

Thus, the unwinding or winding of the first and second strands 9*a*, 9*b* of the flexible element 9 around the first and second parts of the winding pulley 19 is controlled by supplying electricity to the electromechanical actuator 6.

In practice, the supply of electricity to the electromechanical actuator 6 is controlled by a command order received by the electronic control unit 10 coming from the local control unit 12, the central control unit 13 or a sensor.

Here, the motorized drive device 5, in particular the electromechanical actuator 6, is supplied with electricity from an electricity supply grid. In such a case, the electromechanical actuator 6 comprises a power cable, not shown, allowing it to be supplied with electricity from the electricity supply grid of the sector.

Alternatively, the motorized drive device 5, in particular the electromechanical actuator 6, is supplied with electricity using a battery, not shown. In such a case, the battery can be recharged, for example, by a photovoltaic panel or any other energy recovery system, in particular of the thermal type.

Here, the winding pulley 19 and the output shaft 8 of the electromechanical actuator 6 have a same rotation axis X. In other words, the rotation axis of the winding pulley 19 is combined with the rotation axis X of the output shaft 8 of the electromechanical actuator 6.

Thus, the winding pulley 19 is arranged in the extension of the output shaft 8 of the electromechanical actuator 6 and is rotated around a same rotation axis X as the output shaft 8 of the electromechanical actuator 6.

Furthermore, the flexible element 9 forms a so-called open loop between the first end of the first strand 9*a* connected to the first part of the winding pulley 19 and the first end of the second strand 9*b* connected to the second part of the winding pulley 19.

In this way, the first and second strands 9*a*, 9*b* of the flexible element 9 are connected to the winding pulley 19 and separated at the first and second parts thereof.

Preferably, the electromechanical actuator 6 is attached on the upper crosspiece 4*a* of the stationary frame 4 using fasteners 28.

Furthermore, the winding pulley 19 is maintained on the upper crosspiece 4*a* through these same fasteners 28.

In practice, the fasteners 28 of the electromechanical actuator 6 on the upper crosspiece 4*a* of the stationary frame 4 comprise supports, in particular fastening brackets.

Advantageously, these supports 28 are fastened on the upper crosspiece 4*a* of the stationary frame 4 by screwing.

In practice, each support 28 comprises at least one passage hole 29 for a fastening screw, as illustrated in FIG. 2. In one example embodiment, each support 28 may comprise two passage holes 29 for a fastening screw.

Furthermore, a fastening screw passing through a passage hole 29 is screwed in the upper crosspiece 4*a* of the stationary frame 4, in particular in a screwing opening arranged in the upper crosspiece 4*a* of the stationary frame 4. In practice, this fastening screw is of the self-tapping type.

Here, the fasteners 28 of the electromechanical actuator 6 on the upper crosspiece 4*a* of the stationary frame 4 comprise two supports. A first support 28 is assembled at a first end 6*a* of the electromechanical actuator 6, as illustrated in FIG. 2. A second support 28 is assembled at a second end 6*b* of the electromechanical actuator 6, as illustrated in FIGS. 1 and 2. The first end 6*a* of the electromechanical actuator 6 is opposite the second end 6*b* of the electromechanical actuator 6.

Advantageously, each support 28 comprises at least one pin 44 cooperating with a slot 43 arranged in the upper crosspiece 4*a* of the stationary frame 4. In the example embodiment illustrated in FIG. 2, each support 28 comprises two pins 44. These pins 44 are identified in FIG. 2 by their outline on the second support 28 connected to the winding pulley 19.

Thus, each support 28 is oriented and positioned relative to the upper crosspiece 4*a* of the stationary frame 4.

Advantageously, the fastening of the electromechanical actuator 6, as well as the winding pulley 19, on the supports 28 is implemented by fasteners 41, in particular by screwing, as illustrated in FIGS. 1 and 2.

In a variant, not shown, the fasteners of the electromechanical actuator 6, as well as the winding pulley 19, on the supports 28 are resilient snapping elements.

Here and as illustrated in FIGS. 1 and 2, the flexible element 9 of the motorized drive device 5 extends along the upper crosspiece 4*a* of the stationary frame 4 from the first part of the winding pulley 19 to the second part of the winding pulley 19.

Thus, such an arrangement of the flexible element 9 makes it possible to guarantee the movements by sliding of the first opening leaf 3*a* relative to the stationary frame 4, as well as the esthetic appearance of the window 2.

Here and as illustrated in FIGS. 1 and 2, the flexible element 9 extends only on the side of the upper face of the upper crosspiece 4*a*, along at least part of the length L of the upper crosspiece 4*a* of the stationary frame 4.

In practice, the motorized drive device 5 comprises at least two angle transmission pulleys 35 separated by a determined distance S along the length L of the upper crosspiece 4*a*.

At least a first angle transmission pulley 35 is arranged on a first side of the electromechanical actuator 6, i.e., on the side of the first end 6*a* of the electromechanical actuator 6. At least a second angle transmission pulley 35 is arranged on a second side of the electromechanical actuator 6, i.e., on the side of the second end 6*b* of the electromechanical actuator 6.

Here, the motorized drive device 5 comprises an angle transmission pulley 35 arranged on the first side of the electromechanical actuator 6 separated by the predetermined distance S relative to a pair of angle transmission pulleys 35 arranged on the second side of the electromechanical actuator 6, one of these angle transmission pulleys 35 being hidden in FIGS. 1 and 2 by a support 55 of these pulleys.

The number of angle transmission pulleys is not limiting and can be different.

Each angle transmission pulley 35 can for example be made by a loose pulley, in other words mounted freely rotating, in particular on the upper crosspiece 4*a* of the stationary frame 4, or by a stationary pulley, in other words secured to its axis, in particular fastened on the upper crosspiece 4*a* of the stationary frame 4.

Each angle transmission pulley 35 can be a pulley with a grooved wheel, generally called sheave.

As illustrated in FIGS. 1 and 2, the electromechanical actuator 6 and the flexible element 9 are positioned in a box 30 arranged above the window 2, in particular extending above the upper crosspiece 4*a* of the stationary frame 4.

Thus, the electromechanical actuator 6 and the flexible element 9 are hidden in the box 30, so as to guarantee the esthetic appearance of the sliding window 2.

Likewise, the winding pulley 19 is positioned in the box 30 arranged above the window 2.

In a variant, not shown, the box 30 extends partially or completely in front of the stationary frame 4, in the assembled configuration of the window 2 relative to the building.

In this case, the box 30 extends at least partially protruding relative to the stationary frame 4.

In such a case, the box 30 can be either arranged above the upper crosspiece 4*a* of the stationary frame 4 or arranged opposite the upper crosspiece 4*a* of the stationary frame 4, i.e., protruding toward the inside of the building, in the assembled configuration of the window 2 relative to the building.

Advantageously, the window 2 comprises an access hatch 31 to the motorized drive device 5 and, more particularly, to the electromechanical actuator 6 and the flexible element 9, as well as the winding pulley 19.

Thus, the access hatch 31 makes it possible to perform a maintenance operation of the motorized drive device 5 and/or a repair operation thereof.

Here and as illustrated in FIGS. 1 and 2, the access hatch 31 extends over the entire length L of the upper crosspiece 4*a* of the stationary frame 4.

Alternatively, the access hatch 31 extends over part of the length L of the upper crosspiece 4*a* of the stationary frame 4.

Here and as illustrated in FIGS. 1 and 2, the access hatch 31 is arranged in the box 30.

Alternatively, the access hatch 31 is arranged in the upper crosspiece 4*a* of the stationary frame 4, in particular through the first sliding rail 11*a* of the upper crosspiece 4*a* or between the first and second sliding rails 11*a* of the upper crosspiece 4*a*.

Furthermore, in the case where the second opening leaf 3*b* is movable manually, the latter can be moved by the user independently of the first opening leaf 3*a*, in particular if there is no power supply of the motorized drive device 5 or a failure of the motorized drive device 5.

The motorized drive device 5 makes it possible to slide the first opening leaf 3*a* automatically relative to the stationary frame 4 along the sliding direction D, by winding, respectively unwinding, the first strand 9*a* of the flexible element 9 around the first part of the winding pulley 19 and unwinding, respectively winding, the second strand 9*b* of the flexible element 9 around the second part of the winding pulley 19.

The motorized drive device 5 makes it possible to close and open the first opening leaf 3*a* in a motorized manner relative to the stationary frame 4, by sliding along the sliding direction D.

Advantageously, in case of failure of the motorized drive device 5 or a loss of electrical power of the motorized drive device 5, a manual sliding, in particular by the user, of the first opening leaf 3*a* relative to the stationary frame 4 along the sliding direction D can be implemented, following the separation of the flexible element 9 relative to the first opening leaf 3*a* or following the separation of the drive arm 18 relative to the first opening leaf 3*a*.

Furthermore, the use of the flexible element 9 to move the first opening leaf 3*a* relative to the stationary frame 4 makes it possible to minimize the costs of obtaining the motorized drive device 5, and to minimize the bulk of the motorized drive device 5, in particular relative to a belt.

The window 2 also comprises a locking control device 26.

In reference to FIGS. 1 to 5, we now provide a more detailed description of the arrangement between the motorized drive device 5, the fittings system 20 and the locking control device 26.

The drive arm 18 is connected, on the one hand, to the frame 15 of the first opening leaf 3*a* and, more particularly, to the first lateral upright 15*c* of the frame 15 of the first opening leaf 3*a*, and, on the other hand, to the flexible element 9.

The fittings system 20 comprises a latch 21.

The locking control device 26 is configured, on the one hand, to cooperate with the latch 21 and, on the other hand, to be actuated using the flexible element 9, when the electromechanical actuator 6 is electrically activated.

The drive arm 18 supports the locking control device 26.

Thus, the drive arm 18 and the locking control device 26 form a joint mechanical subassembly.

The fittings system 20 also comprises an error-proofing system 27.

After the activation of the error-proofing system 27 and when the electromechanical actuator 6 is electrically activated, the locking control device 26 actuates the latch 21.

Thus, the arrangement formed by the motorized drive device 5, the fittings system 20 and the locking control device 26 of the window 2 makes it possible to simplify the industrialization of the locking control device 26, to guarantee tightness in a closed and locked position of the first opening leaf 3*a* relative to the stationary frame 4, while minimizing the costs of obtaining the window 2.

In this way, such an arrangement of the window 2 makes it possible to lock and unlock the first opening leaf 3*a* relative to the stationary frame 4 by means of the fittings system 20, without modifying a sealing gasket configured to cooperate with the first opening leaf 3*a* and the stationary frame 4, when the closed position of the first opening leaf 3*a* is reached relative to the stationary frame 4, while maintaining the traditional window placement techniques, in particular for adjusting fittings systems.

Furthermore, this arrangement of the window 2 makes it possible to use a fittings system comprising standard elements, in particular the latch 21 having standard characteristics.

In this way, the latch 21 can be provided without any particular reinforcement, so as to minimize the costs of obtaining the window 2 and to guarantee the compatibility of the locking control device 26 with existing components for the fittings systems.

Furthermore, the latch 21 is associated with the drive arm 18 by means of the locking control device 26, so as to secure the first opening leaf 3*a* to the motorized drive device 5 provided with the flexible element 9.

In this way, the movement transmitted by the motorized drive device 5 along a linear direction D is converted into a rotational movement at the latch 21 by means of the locking control device 26.

Here, the first strand 9*a* of the flexible element 9 comprises a second end connected to the locking control device 26. Furthermore, the second strand 9*b* of the flexible element 9 comprises a second end connected to the locking control device 26.

The second end of the first strand 9*a* of the flexible element 9 is opposite the first end of the first strand 9*a* of the flexible element 9 connected to the first part of the winding pulley 19. Furthermore, the second end of the second strand 9*b* of the flexible element 9 is opposite the first end of the second strand 9*b* of the flexible element 9 connected to the second part of the winding pulley 19.

Thus, the flexible element 9 is made in two parts. The first part of the flexible element 9 is formed by the first strand 9*a* extending between the first part of the winding pulley 19 and the locking control device 26. Furthermore, the second part of the flexible element 9 is formed by the second strand 9*b* extending between the second part of the winding pulley 19 and the locking control device 26.

Preferably, the drive arm 18 is connected to the flexible element 9 by means of the locking control device 26.

Advantageously, the locking control device 26 comprises a drive element 47, on the one hand, connected to the flexible element 9 and, on the other hand, mounted rotating relative to the drive arm 18, about a rotation axis Y.

Here, the drive element 47 is mounted rotating relative to the drive arm 18 using a bearing 51.

Advantageously, the box 30 comprises a slot, not shown and configured to allow the passage of an upper part of the drive arm 18 and at least the bearing 51, during a movement of the drive arm 18 relative to the stationary frame 4 along the sliding direction D.

Thus, the drive arm 18 can be moved along the box 30, in particular at least partially across from an outer face of the box 30 oriented toward the inside of the building, in the assembled configuration of the window 2 relative to the building, while being connected to the drive element 47 by means of the bearing 51.

In this way, the upper part of the drive arm 18, in particular at least the bearing 51, is configured to move inside the slot arranged in the box 30.

Furthermore, a lower part of the drive arm 18 is arranged outside the box 30.

Advantageously, the slot of the box 30 is arranged between the access hatch 31, in the closed position relative to the box 30, and the stationary frame 4.

Preferably, the drive element 47 is arranged above the upper crosspiece 15*a* of the frame 15 of the first opening leaf 3*a* and, more particularly, at or above the upper crosspiece 4*a* of the stationary frame 4, in the assembled configuration of the window 2 relative to the building.

Thus, the connection of the drive element 47 with the flexible element 9 is simplified, since the flexible element 9 extends along the upper crosspiece 4*a* of the stationary frame 4.

Figure 4:
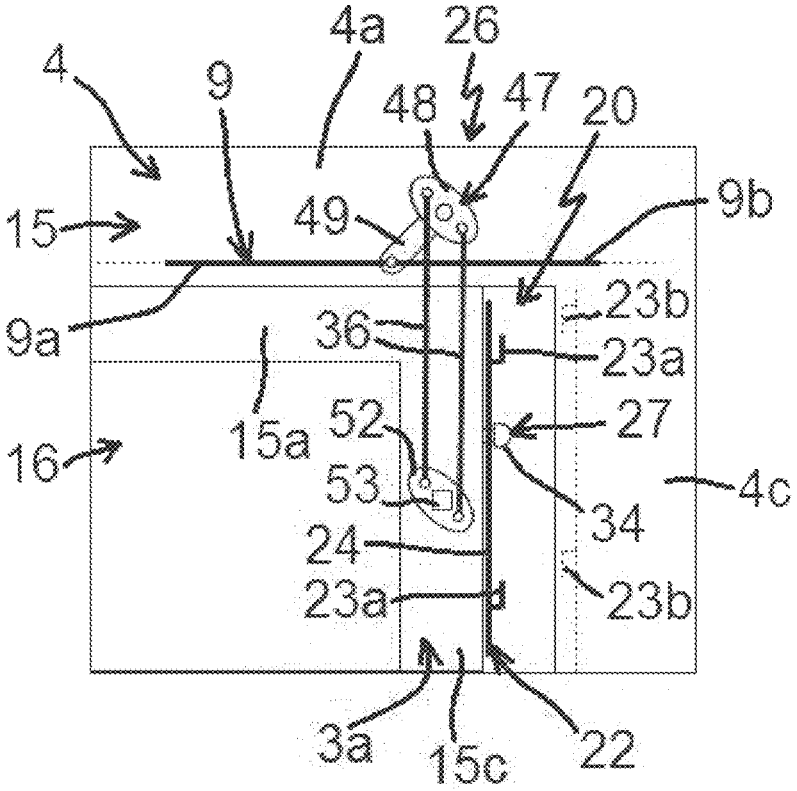
FIG. 4 is an assembled schematic front view of the window, showing for the most part the same parts as FIG. 3, where the opening leaf is in a partially open position relative to the stationary frame and where the drive arm has been omitted.
Figure 5:
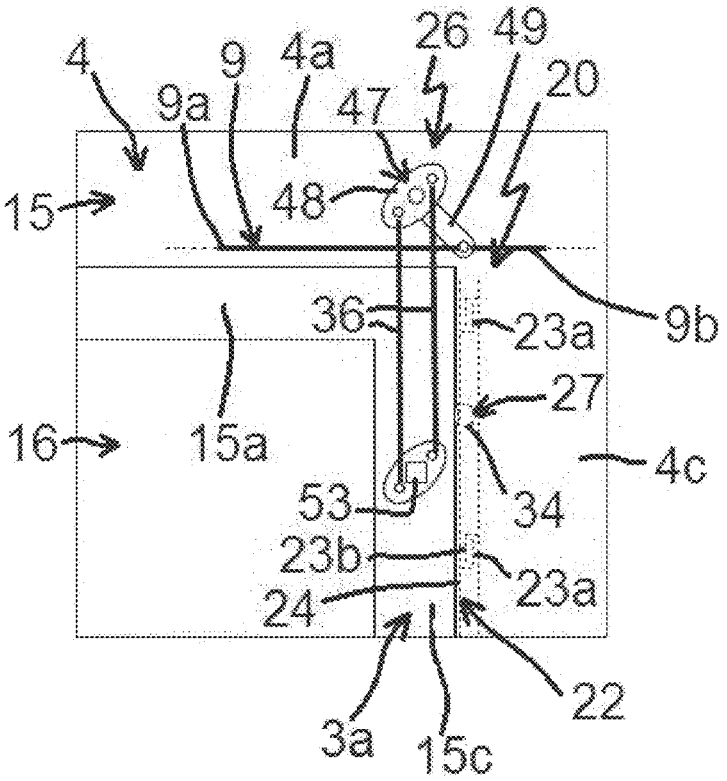
FIG. 5 is a view similar to FIG. 4, where the opening leaf is in a closed and locked position relative to the stationary frame.

In this first embodiment, illustrated in FIGS. 3 to 5, the drive element 47 comprises a rotary plate 48 and a transmission arm 49.

In one example embodiment, the fastening of the flexible element 9, in particular of the first and second strands 9*a*, 9*b* of the flexible element 9, on the transmission arm 49 is done using a knot.

The fastening of the flexible element on the transmission arm is not limiting and can be different. In particular, it can be a fastening by screwing a fastening screw through an eyelet of the flexible element and a hole of the transmission arm.

Preferably, the locking control device 26 comprises two stops, not shown, configured to cooperate with the transmission arm 49.

Thus, the movement travel of the transmission arm 49, during the electrical activation of the electromechanical actuator 6 for the driving of the flexible element 9, is limited by the stops.

Advantageously, the stops of the locking control device 26 are adjustable, for example by the sliding of each stop through a respective groove arranged in the drive arm 18.

Advantageously, the fittings system 20 also comprises a window catch 22 and locking elements 23*a* of the first opening leaf 3*a* relative to the stationary frame 4.

Here, the fittings system 20 is mounted along the first lateral upright 15*c* of the frame 15 of the first opening leaf 3*a*.

Preferably, the drive arm 18 and the latch 21 of the fittings system 20 are arranged in the upper part of the first lateral upright 15*c* of the frame 15 of the first opening leaf 3*a*, in the assembled configuration of the window 2 relative to the building.

Thus, the drive arm 18 and the latch 21 are arranged as close as possible to the flexible element 9, since the flexible element 9 extends along the upper crosspiece 4*a* of the stationary frame 4.

Here, the window catch 22 is arranged inside the first lateral upright 15*c* of the frame 15 of the first opening leaf 3*a*.

In a variant, not shown, the window catch 22 can also be arranged partially inside the upper crosspiece 15*a* or the lower crosspiece of the frame 15 of the first opening leaf 3*a*.

Advantageously, the window catch 22 includes at least one control rod 24. Furthermore, the window catch 22 also comprises a body, not shown.

In practice, the body of the window catch 22 is stationary relative to the first lateral upright 15*c* of the frame 15 of the first opening leaf 3*a*. Furthermore, the control rod 24 is configured to move relative to the body of the window catch 22.

Advantageously, the control rod 24 is made in several parts connected to one another, in particular using holding elements.

Here, the movement of the control rod 24 of the window catch 22 is done along the first lateral upright 15*c* of the frame 15 of the first opening leaf 3*a*, in particular along a vertical direction, in the assembled configuration of the window 2 relative to the building.

Advantageously, the control rod 24 of the window catch 22 comprises at least one hook 23*a* forming a locking element. The stationary frame 4, in particular the first lateral upright 4*c* of the stationary frame 4, comprises at least one strike, not shown.

Here and non-limitingly, the control rod 24 of the window catch 22 comprises two hooks 23*a* and the stationary frame 4 comprises two strikes.

Each hook 23*a* of the control rod 24 is configured to cooperate with a strike of the stationary frame 4.

The hooks 23*a* of the control rod 24, as well as the strikes arranged in the stationary frame 4, form at least part of the locking elements of the fittings system 20.

When the hooks 23*a* of the control rod 24 are engaged in the strikes of the stationary frame 4, the first opening leaf 3*a* is in a closed and locked position relative to the stationary frame 4.

When the hooks 23*a* of the control rod 24 are disengaged relative to the strikes of the stationary frame 4, the first opening leaf 3*a* is in an unlocked position relative to the stationary frame 4, which may further be closed or open.

Preferably, the latch 21 is arranged inside the first lateral upright 15*c* of the frame 15 of the first opening leaf 3*a*.

Advantageously, the latch 21 comprises at least a casing 37, a shaft 33, commonly called square, a drive socket 38 and a bolt 25. The drive socket 38 comprises a housing 45. A first end of the shaft 33 is arranged inside the housing 45 of the drive socket 38. The bolt 25 is configured to cooperate with a hole 46 arranged in the control rod 24.

Here, during the rotational driving of the shaft 33 of the latch 21 by the locking control device 26, whether to lock the first opening leaf 3*a* relative to the stationary frame 4 or to unlock the first opening leaf 3*a* relative to the stationary frame 4, the drive socket 38 is rotated inside the casing 37 of the latch 21, then the bolt 25 of the latch 21 is translated, so as to move the control rod 24 along the lateral upright 15*c* of the frame 15 of the first opening leaf 3*a*, in particular along a vertical direction, in the assembled configuration of the window 2 relative to the building.

In one example embodiment, not shown, the mechanical connection between the drive element 47 and the drive arm 18, in particular at the bearing 51, can comprise notches.

Thus, such notches make it possible to produce mechanical hard spots at the mechanical connection between the drive element 47 and the drive arm 18, in an unlocked position of the first opening leaf 3*a* relative to the stationary frame 4.

In this way, the notches arranged at the mechanical connection between the drive element 47 and the drive arm 18 make it possible to limit the torque transmitted by the shaft 33 to the latch 21, during the closing movement of the first opening leaf 3*a* relative to the stationary frame 4.

Preferably, the drive arm 18 is stationary, therefore immobile, relative to the frame 15 of the first opening leaf 3*a*.

In this way, the connection between the drive arm 18 and the frame 15 of the first opening leaf 3*a* is simplified and makes it possible to minimize the costs of obtaining the window 2.

Advantageously, the drive arm 18 is arranged in the upper part of the first lateral upright 15*c* of the frame 15 of the first opening leaf 3*a*.

Thus, the drive arm 18 is configured to attach to the flexible element 9 arranged above the stationary frame 4, in particular the upper crosspiece 4*a* of the stationary frame 4.

Preferably, the drive arm 18 is fastened on the first lateral upright 15*c* of the frame 15 of the first opening leaf 3*a* comprising the fittings system 20.

In practice, the drive arm 18 is fastened on the first lateral upright 15*c* of the frame 15 of the first opening leaf 3*a* configured to cooperate with the first lateral upright 4*c* of the stationary frame 4, when the closed position of the first opening leaf 3*a* is reached relative to the stationary frame 4.

In practice, the drive arm 18 is fastened on the first lateral upright 15*c* of the frame 15 of the first opening leaf 3*a* using fasteners 39, in particular removable using a tool.

Here, the fastening elements of the drive arm 18 on the first opening leaf 3*a* are fastening elements by screwing, in the example screws 39.

The type of fasteners of the drive arm on the first opening leaf is not limiting and can be different. These may in particular involve fasteners by resilient snapping.

Here, there are two fasteners 39 of the drive arm 18 on the first opening leaf 3*a*.

The number of fasteners of the drive arm on the first opening leaf is not limiting and can be different, in particular three or more.

Advantageously, the drive arm 18 is fastened on the frame 15 of the first opening leaf 3*a*, after the installation of the first opening leaf 3*a* inside the stationary frame 4 and, in the present case, also of the second opening leaf 3*b* inside the stationary frame 4, during which installation the adjustments of the fittings system 20 and sliding elements are done.

Thus, the adjustments of the fittings system 20, in particular of the hooks 23*a* of the control rod 24 relative to the strikes of the stationary frame 4, and sliding elements can be implemented manually and conventionally, like for a window without the motorized drive device 5.

Preferably, the drive arm 18 is fastened on the frame 15 of the first opening leaf 3*a*, after the electrical connection of the electromechanical actuator 6, either to the electrical power grid of the sector or to a battery.

Preferably, the drive arm 18 is fastened on the first lateral upright 15*c* of the frame 15 of the first opening leaf 3*a* by means of the latch 21.

Here, the latch 21 comprises screwing holes 50 configured to cooperate with the fastening elements 39 by screwing, so as to fasten the drive arm 18 on the first lateral upright 15*c* of the frame 15 of the first opening leaf 3*a*.

Here, each fastening element 39 is configured to cooperate with a passage hole 42 arranged in the drive arm 18 and with a screwing hole 50 arranged in the latch 21.

Furthermore, the latch 21 comprises at least a first screwing hole 50 above the drive socket 38 and at least a second screwing hole 50 below the drive socket 38, in the assembled configuration of the window 2 relative to the building. The first and second screwing holes 50 of the latch 21 are configured to cooperate respectively with one of the fastening elements 39.

In this way, the forces transmitted to the drive arms 18 by means of the flexible element 9 are distributed on the latch 21 on either side of the drive socket 38, owing to the placement of the fastening elements 39 relative to the latch 21.

Preferably, the latch 21 has screwing holes 50 and a housing 45 configured to receive the drive socket 38 as well as the shaft 33 similar to those of a latch of the standard manual handle, in particular in terms of their placement and sizing.

Thus, a standard manual handle, for example a handle similar to the handle 40 of the second opening leaf 3*b*, can be arranged to replace the drive arm 18, so as to close and manually lock the first opening leaf 3*a* relative to the stationary frame 4. In this way, in case of failure of the motorized drive device 5 or loss of the electrical power supply of the motorized drive device 5, the drive arm 18 can be replaced by a standard manual handle, so as to manually move the first opening leaf 3*a* relative to the stationary frame 4 and manually lock the first opening leaf 3*a* relative to the stationary frame 4 by actuating the latch 21.

Preferably, the drive arm 18 is fastened on an outer face of the first lateral upright 15*c* of the frame 15 of the first opening leaf 3*a*.

Thus, the drive arm 18 is fastened on a face of the first lateral upright 15*c* of the frame 15 of the first opening leaf 3*a* oriented toward the outside of the window 2, in other words visible by the user.

In this way, the fastening of the drive arm 18 on the first lateral upright 15*c* of the frame 15 of the first opening leaf 3*a* is made easier relative to a fastening of the drive arm 18 on an inner zone of the frame 15 of the first opening leaf 3*a*, in particular located at the sliding rail 11*a* of the upper crosspiece 4*a* of the stationary frame 4, in the assembled configuration of the window 2.

Advantageously, the drive arm 18 is assembled with the first opening leaf 3*a* on the inner side of the frame 15 of the first opening leaf 3*a*, in the assembled configuration of the window 2 relative to the building.

The inner side of the frame 15 of the first opening leaf 3*a* is oriented toward the inside of the building, in the assembled configuration of the window 2 relative to the building.

The locking control device 26 is arranged on the drive arm 18 and, in particular, on the outside of the frame 15 of the first opening leaf 3.

Thus, the locking control device 26 is hidden behind the drive arm 18, so as to improve the esthetic appearance of the window 2.

In this way, the drive arm 18 covers the locking control device 26, like a cover, so as to hide the different elements making up the latter and improve the esthetic appearance of the window 2.

Advantageously, the window 2 comprises a trim element, not shown. The trim element is configured to cover at least the drive arm 18.

Thus, the trim element makes it possible to hide the drive arm 18, in the assembled configuration of the window 2.

Preferably, the trim element is the same color as the frame 15 of the first opening leaf 3*a*, so as to improve the esthetic appearance of the window 2.

Advantageously, the trim element is assembled on the drive arm 18 and/or on the frame 15 of the first opening leaf 3*a*, after the assembly of the drive arm 18 on the first lateral upright 15*c* of the frame 15 of the first opening leaf 3*a*.

In one example embodiment, the trim element is configured to cover only the drive arm 18.

In another example embodiment, the trim element is configured to cover the drive arm 18 as well as part or all of the first lateral upright 15*c* of the frame 15 of the first opening leaf 3*a*, in particular along the height of the frame 15, in the assembled configuration of the window 2 relative to the building.

In practice, the trim element is fastened relative to the first opening leaf 3*a* using fasteners, following the assembly of the drive arm 18 on the frame 15 of the first opening leaf 3*a*.

Advantageously, the fasteners of the trim element are configured to cooperate with the drive arm 18 and/or with the first lateral upright 15*c* of the frame 15 of the first opening leaf 3*a*.

The fasteners of the trim element relative to the first opening leaf 3*a* can in particular be fasteners by resilient snapping or by screwing.

Furthermore, the trim element can be made in a single part or in several parts. In the case where the trim element comprises several parts, each part can be made from the same material or from a different material, which may for example be a plastic material or a metallic material, such as aluminum.

Advantageously, the error-proofing system 27 comprises a retractable pin 34. The retractable pin 34 is configured to be moved between an idle position, in which the window catch 22 is blocked, and an activated position, in which the window catch 22 is released. Furthermore, the error-proofing system 27 is activated when the retractable pin 34 is pushed inside a housing, not shown, arranged in the frame 15.

In practice, the pushing of the retractable pin 34 into the aforementioned housing is done by causing the retractable pin 34 to bear against the stationary frame 4, in particular the first lateral upright 4*c* of the stationary frame 4, i.e., when the first opening leaf 3*a* is in the closed position relative to the stationary frame 4.

Here, the bearing of the retractable pin 34 against the stationary frame 4 is done, when the first opening leaf 3*a* is close to the stationary frame 4, in the closed position of the first opening leaf 3*a* relative to the stationary frame 4.

Advantageously, when the window catch 22 is released using the error-proofing system 27, the control rod 24 of the window catch 22 is configured to move relative to the body of the window catch 22 between a first position, called unlocking position of the first opening leaf 3*a* relative to the stationary frame 4, and a second position, called locking position of the first opening leaf 3*a* relative to the stationary frame 4, and vice versa.

Thus, the error-proofing system 27 is configured to prevent a movement of the control rod 24 of the window catch 22 relative to the body of the window catch 22, between its unlocked position and its locked position, as long as the retractable pin 34 is kept in its idle position.

Advantageously, the retractable pin 34 extends in a direction perpendicular to the window catch 22.

Advantageously, the locking control device 26 comprises an actuating mechanism 32 of the latch 21 configured to rotate the shaft 33 of the latch 21, during the driving of the flexible element 9 by the electromechanical actuator 6.

Thus, the actuating mechanism 32 of the locking control device 26 is configured to transform the translational movement of the flexible element 9 applied to the drive arm 18, in particular by the drive element 47, during the electrical activation of the electrochemical actuator 6, into a rotational movement of the shaft 33 of the latch 21 of the fittings system 20, during the locking or unlocking of the first opening leaf 3*a* relative to the stationary frame 4.

Advantageously, the locking control device 26 also comprises a transmission element 52 connected, on the one hand, to the mechanism 32 and, on the other hand, to the shaft 33 of the latch 21.

Here and as illustrated in FIGS. 3 to 5, the transmission element 52 is a rotary plate.

In this first embodiment, illustrated in FIGS. 3 to 5, the actuating mechanism 32 of the latch 21 comprises lever arms 36.

Here, the lever arms 36 are made in the form of rods and there are two.

In practice, each lever arm 36 is connected, on the one hand, to the drive element 47 and, in particular, to the rotary plate 48, and, on the other hand, to the transmission element 52.

The lever arms 36 are configured to transmit the rotational movement from the drive element 47 to the transmission element 52. Furthermore, the transmission element 52 is configured to rotate the shaft 33 of the latch 21.

The connection of each of the lever arms 36, on the one hand, to the drive element 47, in particular to the rotary plate 48, and, on the other hand, to the transmission element 52 is done using a bearing.

Advantageously, the transmission element 52 comprises a housing 53. A second end of the shaft 33 of the latch 21 is arranged inside the housing 53 of the transmission element 52.

Thus, the cooperation of the second end of the shaft 33 of the latch 21 with the housing 53 of the transmission element 52 makes it possible to transmit the movement from the lever arms 36 to the shaft 33 of the latch 21, then to the control rod 24 of the window catch 22.

Advantageously, the arrangement formed by the motorized drive device 5, the fittings system 20 and the locking control device 26 of the window 2 makes it possible to do away with a maneuvering handle of the first opening leaf 3*a*, generally arranged at mid-height of the window 2.

Thus, the first opening leaf 3*a* can be moved only using the motorized drive device 5 after receiving a control order by the electronic control unit 10 coming from one of the control units 12, 13.

In a variant, not shown, the actuating mechanism 32 of the latch 21 may comprise a single lever arm 36, made in the form of a rod.

In a variant, not shown, the actuating mechanism 32 of the latch 21 may comprise two lever arms 36, made using flexible elements tensioned between the drive element 47 and the transmission element 52.

Figure 6:
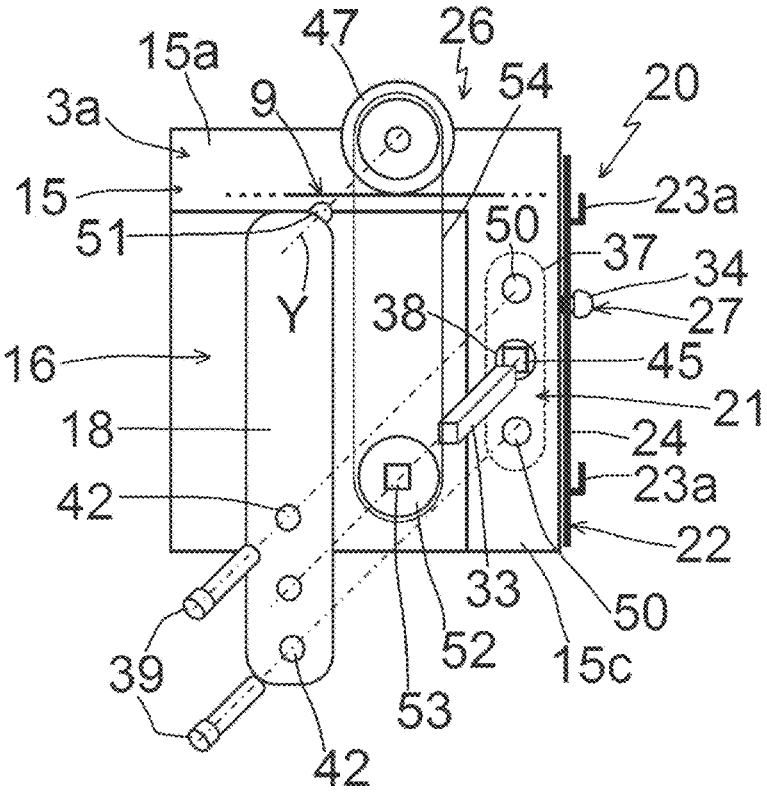
FIG. 6 is a view similar to FIG. 3 illustrating a locking control device according to a second embodiment.
Figure 7:
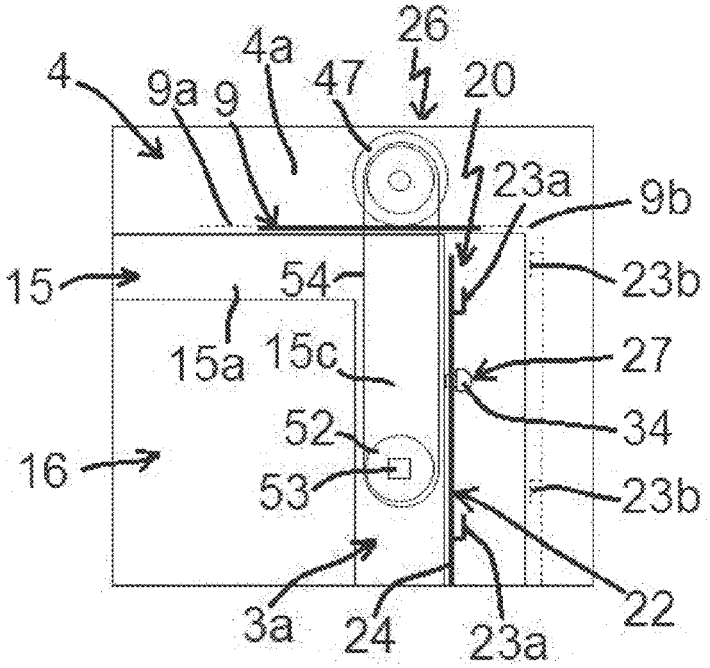
FIG. 7 is an assembled schematic front view of a window incorporating the device of the second embodiment, this FIG. 7 showing for the most part the same parts as FIG. 6, where the opening leaf is in a partially open position relative to the stationary frame and where the drive arm has been omitted.
Figure 8:
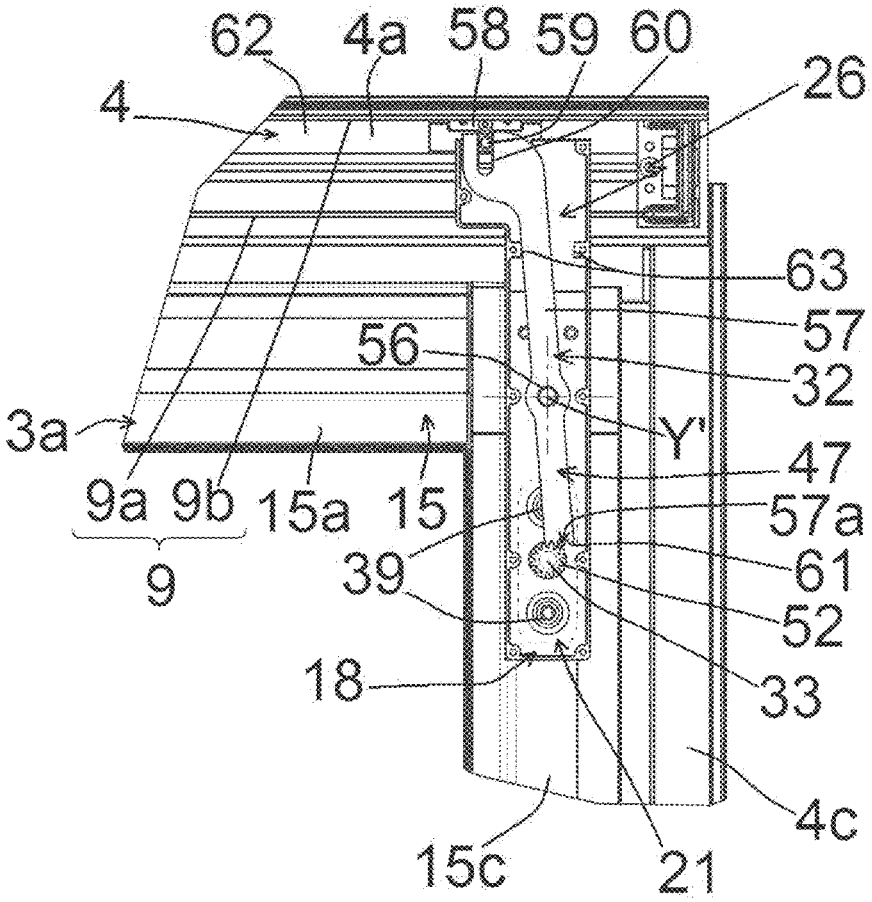
FIG. 8 is a view similar to FIG. 5 illustrating a locking control device according to a fourth embodiment.
Figure 9:
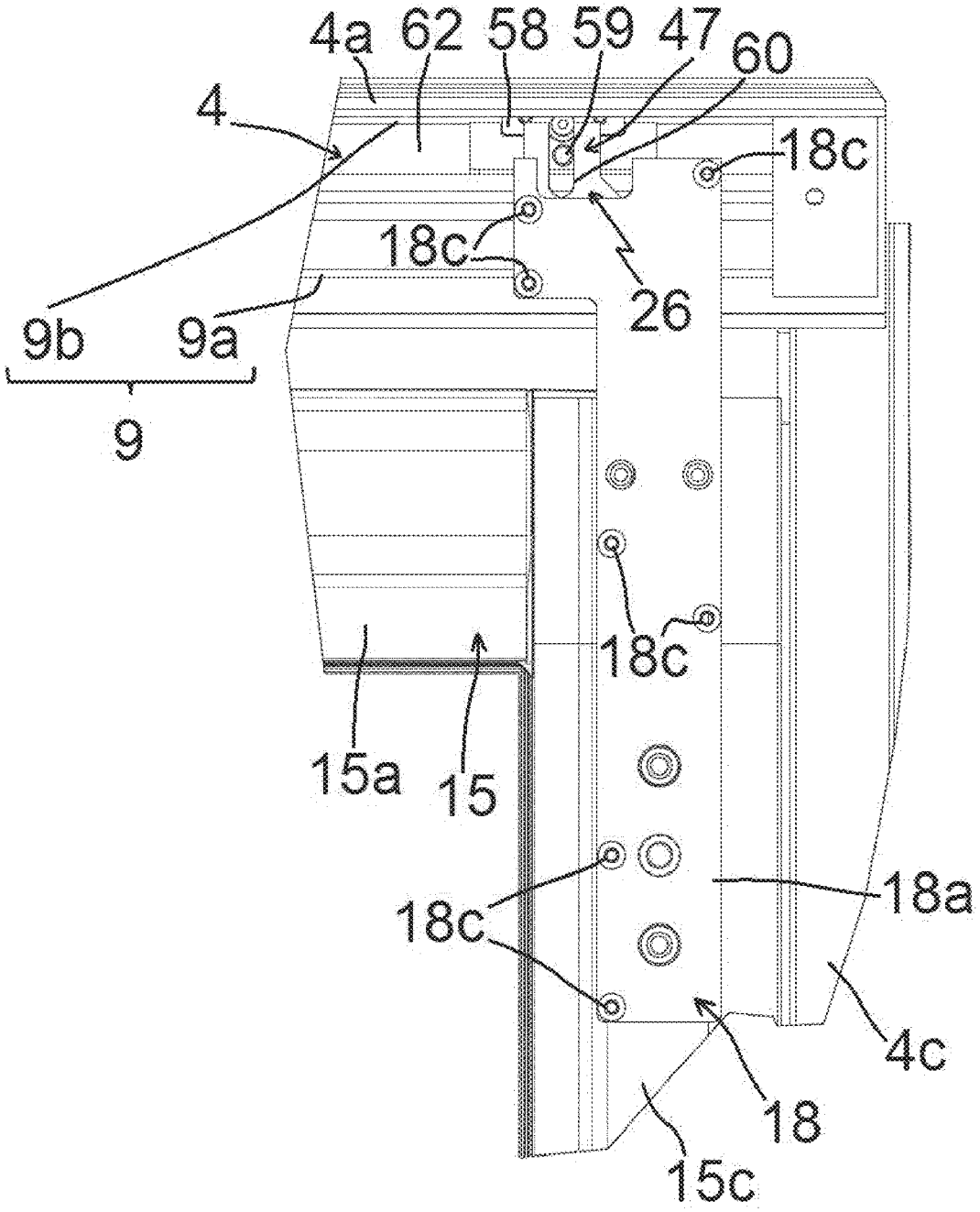
FIGS. 9 and 10 are views similar to FIG. 8 illustrating a locking control device according to a fifth embodiment, where a cover of the drive arm is visible in FIG. 9 and removed in FIG. 10, in order to make FIG. 10 easier to read.
Figure 10:
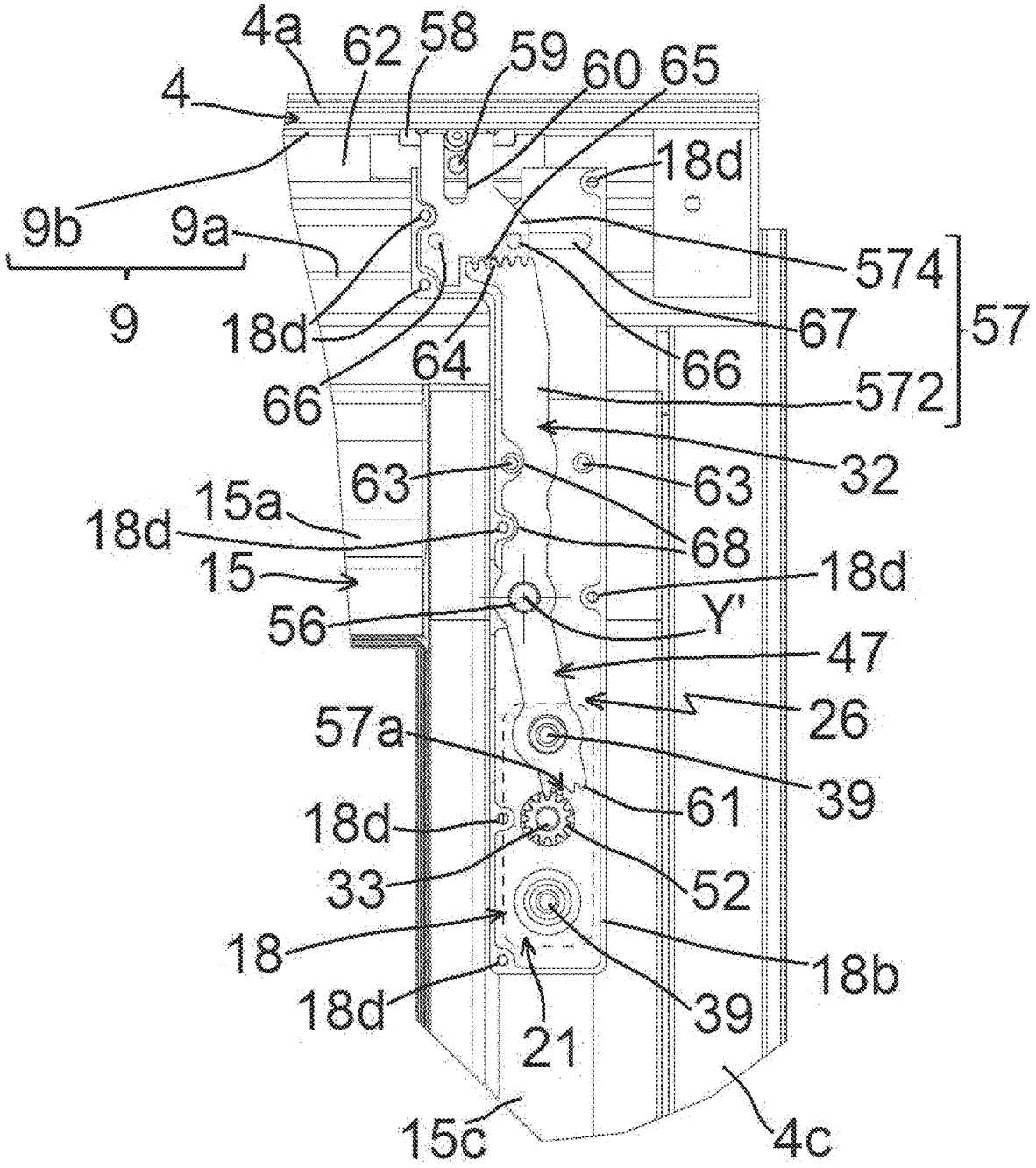

In a second embodiment, shown in FIGS. 6 and 7, in a third embodiment, not shown, in a fourth embodiment, shown in FIG. 8, and in a fifth embodiment, shown in FIGS. 9 and 10, the elements similar to those of the first embodiment bear the same references and operate as explained above. Hereinafter, we primarily describe the differences between these embodiments and the previous one. Hereinafter, when a reference sign is used without being reproduced in one of FIGS. 6 to 10, it corresponds to the object bearing the same reference in one of FIGS. 1 to 5.

In reference to FIGS. 6 to 7, we now describe the arrangement between the motorized drive device 5, the fittings system 20 and the locking control device 26, according to the second embodiment.

In this second embodiment, the actuating mechanism 32 of the latch 21 comprises an additional flexible element 54.

Here and as illustrated in FIGS. 6 and 7, the drive element 47 and the transmission element 52 are pulleys.

The additional flexible element 54 is configured to transmit the rotational movement from the pulley of the drive element 47 to the pulley of the transmission element 52. Furthermore, the pulley of the transmission element 52 is configured to rotate the shaft 33 of the latch 21.

In practice, the additional flexible element 54 is a cable or a cord.

It may be made from a synthetic material, for example nylon or polyethylene with a very high molar mass.

Thus, the use of an additional flexible element 54 made from a synthetic material makes it possible to minimize the diameter of the pulleys 47, 52 of the locking control device 26.

The material of the additional flexible element is not limiting and can be different. In particular, it can be a steel.

Advantageously, the pulley of the transmission element 52 also comprises the housing 53 configured to receive the shaft 33 of the latch 21.

Preferably, the pulley of the drive element 47 comprises a first winding surface of the flexible element 9 and a second winding surface of the additional flexible element 54.

In practice, each of the first and second winding surfaces of the pulley of the drive element 47 can be made in the form of a groove.

In this example embodiment, the additional flexible element 54 is made in the form of a so-called closed loop.

In practice, the additional flexible element 54 is driven around the pulley of the drive element 47 and the pulley of the transmission element 52.

In a variant, not shown, the additional flexible element 54 is made in the form of a so-called open loop.

In such a case, the additional flexible element 54 comprises a first strand and a second strand.

One end of the first strand of the additional flexible element 54 is connected to a first part of the pulley of the drive element 47. One end of the second strand of the additional flexible element 54 is connected to a second part of the pulley of the drive element 47.

Advantageously, the end of each of the first and second strands of the additional flexible element 54 is respectively attached to the first part or to the second part of the pulley of the drive element 47 using fasteners.

Thus, the first end of each of the first and second strands of the additional flexible element 54 is respectively fastened directly to the first part or to the second part of the pulley of the drive element 47.

In practice, the fasteners of the end of each of the first and second strands of the additional flexible element 54 are cable-clamp elements.

These fasteners can be screws, in particular of the self-tapping type, screwing into the pulley of the drive element 47, so as to fasten the first and second strands of the additional flexible element 54 by jamming between the head of the screws and the winding surface of the additional flexible element 54 of the pulley of the drive element 47. In such a case, each of the first and second strands of the additional flexible element 54 can be wound around the pulley of the drive element 47.

Thus, the winding of the additional flexible element 54 around the pulley of the drive element 47 makes it possible to increase the rotation angle of the shaft 33 of the latch 21, in particular past 90° and, for example, around 180°, so as to activate a latch 21 requiring a half-revolution of the shaft 33 to reach the locked position of the first opening leaf 3*a* relative to the stationary frame 4.

Furthermore, the winding of the additional flexible element 54 around the pulley of the drive element 47 makes it possible to adjust the ratio between the force on the flexible element 9 and the force on the shaft 33 of the latch 21, during the locking of the first opening leaf 3*a* relative to the stationary frame 4, without requiring a substantial lever arm, so as to preserve the compactness of the locking control device 26.

We now describe the arrangement between the motorized drive device 5, the fittings system 20 and the locking control device 26, according to the third embodiment, which is not shown.

In this third embodiment, the actuating mechanism 32 of the latch 21 comprises a gear.

Here, the drive element 47 and the transmission element 52 are pinions.

In one example embodiment, the pinion of the drive element 47 is meshed with the pinion of the transmission element 52 by means of one or several other pinions.

In a variant, the pinion of the drive element 47 is meshed directly with the pinion of the transmission element 52.

In all cases, the pinions of the elements 47 and 52 belong to a torque transmission gear, from the drive element 47 to the shaft 33, via the transmission element 52.

The gear of the actuating mechanism 32 of the latch 21 is configured to rotate the shaft 33 of the latch 21.

Advantageously, the pinion 52 also comprises the housing 53 configured to receive the shaft 33 of the latch 21.

In reference to FIG. 8, we now describe the arrangement between the motorized drive device 5, the fittings system 20 and the locking control device 26, according to the fourth embodiment.

In this fourth embodiment, the drive element 47 is connected to the flexible element 9. Furthermore, the drive element 47 is mounted rotatably relative to the drive arm 18, around a rotation axis Y'.

Here, the drive element 47 is a single part and the latter is mounted rotatably relative to the drive arm 18, around a rotation axis Y'.

Advantageously, the drive element 47 is mounted rotating relative to the drive arm 18 using a shaft 56.

Here, the shaft 56 is configured to cooperate with an opening, not shown, arranged in the drive element 47.

Advantageously, the drive element 47 is an integral part of the actuating mechanism 32 of the latch 21.

Preferably, the drive element 47 is arranged at least partially inside the drive arm 18.

Thus, in an assembled configuration of the locking control device 26, the drive element 47 is hidden by the drive arm 18.

Furthermore, the drive element 47 is arranged, on the one hand, partially below the upper crosspiece 15*a* of the frame 15 of the first opening leaf 3*a* and, more particularly, below the upper crosspiece 4*a* of the stationary frame 4, in the assembled configuration of the window 2 relative to the building, and, on the other hand, partially above the upper crosspiece 15*a* of the frame 15 of the first opening leaf 3*a*, in the assembled configuration of the window 2 relative to the building.

In this fourth embodiment, illustrated in FIG. 8, the drive element 47 comprises a transmission arm 57.

Advantageously, the connection of the flexible element 9 to the drive element 47 is done using a shuttle 58.

Furthermore, the shuttle 58 is fastened on the flexible element 9, in particular on the second strand 9*b* of the flexible element 9, using fasteners, not shown.

In practice, the fasteners of the flexible element 9, in particular of the second strand 9*b* of the flexible element 9, on the shuttle 58 can be of the cable-clamp type.

Here, these fasteners are screws, of which there are for example two, configured to be screwed respectively in a screwing hole of the shuttle 58, so as to fasten the flexible element 9, in particular the second strand 9*b* of the flexible element 9, by jamming between the head of the screws and a surface of the shuttle 58.

Preferably, the stationary frame 4, in particular the upper crosspiece 4*a* of the stationary frame 4, comprises a crosshead guide 62. Furthermore, the shuttle 58 is configured to slide inside the crosshead guide 62 of the stationary frame 4.

Thus, the movements of the shuttle 58, during the driving of the flexible element 9, are guided inside the crosshead guide 62 of the stationary frame 4.

Advantageously, the shuttle 58 comprises a pin 59 configured to cooperate with a slot 60 of the transmission arm 57.

In the example embodiment illustrated in FIG. 8, the slot 60 of the transmission arm 57 is U-shaped.

In a variant, not shown, the slot 60 of the transmission arm 57 is in the shape of an oblong hole.

Here, the pin 59 of the shuttle 58 is engaged in the slot 60 of the transmission arm 57, both during a movement of the first opening leaf 3*a* relative to the stationary frame 4, irrespective of the movement direction of the first opening leaf 3*a* relative to the stationary frame 4, i.e., toward the closed position or toward an open position, and when the first opening leaf 3*a* is stopped relative to the stationary frame 4.

During a movement of the first opening leaf 3*a* relative to the stationary frame 4, irrespective of the movement direction of the first opening leaf 3*a* relative to the stationary frame 4, the pin 59 of the shuttle 58 bears against an edge of the slot 60 of the transmission arm 57.

During a movement of the first opening leaf 3*a* relative to the stationary frame 4, done by the electromechanical actuator 6, toward the closed position of the first opening leaf 3*a* relative to the stationary frame 4, the cooperation of the pin 59 of the shuttle 58 with the slot 60 of the transmission arm 57 allows the locking of the first opening leaf 3*a* relative to the stationary frame 4.

Here and preferably, the electromechanical actuator 6 is of the reversible type.

Advantageously, the electromechanical actuator 6 has no brake, in particular to allow the electromechanical actuator 6 to be reversible.

The length of the slot 60 arranged in the transmission arm 57 makes it possible to offset assembly allowances of the locking control device 26, so as to guarantee the cooperation of the pin 59 of the shuttle 58 with the slot 60 of the transmission arm 57.

Advantageously, the transmission arm 57 comprises, at one of its ends 57*a*, a rack 61.

Furthermore, the transmission element 52 is a toothed wheel. The toothed wheel is configured to be assembled on the shaft 33 of the latch 21. The rack 61 of the transmission arm 57 is configured to cooperate with the toothed wheel 52, in the assembled configuration of the locking control device 26.

Thus, the rack 61 of the transmission arm 57 is configured to rotate the toothed wheel 52 and, as a result, the shaft 33 of the latch 21, during the electrical activation of the electromechanical actuator 6.

In this way, during a movement of the shuttle 58, done by the electrical activation of the electromechanical actuator 6 and therefore the flexible element 9, the transmission arm 57 is rotated around the rotation axis Y'. Then, the toothed wheel 52 is rotated by means of the rack 61 of the transmission arm 57.

Here, the toothed wheel 52 and the shaft 33 of the latch 21 are configured to be rotated using the transmission arm 57 relative to the drive arm 18.

Advantageously, the toothed wheel 52 is an integral part of the actuating mechanism 32 of the latch 21.

The locking control device 26 thus makes it possible to command the locking and unlocking of the first opening leaf 3*a* relative to the stationary frame 4.

Preferably, the locking control device 26 comprises two stops 63 configured to cooperate with the transmission arm 57.

Thus, the movement travel of the transmission arm 57, during the electrical activation of the electromechanical actuator 6 for the driving of the flexible element 9, is limited by the stops 63.

Advantageously, the locking control device 26 can also comprise a resilient return element, not shown. The resilient return element is connected, on the one hand, to the frame 15 of the first opening leaf 3*a* and, on the other hand, to the transmission arm 57. The resilient return element is configured to keep the transmission arm 57 in an idle position.

Here, the resilient return element is a spring, which can for example be of the spiral type.

Advantageously, the slot 60 of the transmission arm 57 is configured so that the pin 59 of the shuttle 58 engages therein during the assembly of the drive arm 18 relative to the first opening leaf 3*a*.

Preferably, the assembly of the drive arm 18 relative to the first opening leaf 3*a* is done after the installation of the first opening leaf 3 relative to the stationary frame 4 or after a maintenance operation requiring the disassembly of the drive arm 18 relative to the first opening leaf 3*a*.

In reference to FIGS. 9 and 10, we now describe the arrangement between the motorized drive device 5, the fittings system 20 and the locking control device 26, according to the fifth embodiment. This fifth embodiment is a variant of the fourth embodiment illustrated in FIG. 8. The elements similar to those of the fourth embodiment bear the same references and operate as explained above. Hereinafter, we primarily describe the differences between this fifth embodiment and the fourth embodiment.

Advantageously, the drive arm 18 comprises a cover 18*a* and a body 18*b*. The cover 18*a* is configured to cover the body 18*b* of the drive arm 18.

Advantageously, the cover 18*a* is fastened on the body 18*b* of the drive arm 18 using fasteners, in the assembled configuration of the drive arm 18.

Here, the fastening of the cover 18*a* on the body 18*b* of the drive arm 18 is done by screwing. The cover 18*a* comprises passage holes 18*c*, visible in FIG. 9, configured to cooperate with fastening screws, not shown. Furthermore, the body 18*b* of the drive arm 18 comprises fastening holes 18*d*, visible in FIG. 10, configured to cooperate with the fastening screws.

Such a construction of the drive arm 18 comprising the cover 18*a* and the body 18*b* can be implemented similarly in the fourth embodiment described previously, in reference to FIG. 8, as well as in the first, second and third embodiments.

Advantageously, the drive element 47 and, more particularly, the transmission arm 57 comprises a first part 572 and a second part 574. The first part 572 of the transmission arm 57 comprises a first gear segment 64 configured to cooperate with a second gear segment 65 of the second part 574 of the transmission arm 57, in the assembled configuration of the locking control device 26. Furthermore, the second part 574 of the transmission arm 57 comprises at least a first guide element 66 configured to cooperate with a second guide element 67 arranged at the drive arm 18.

Advantageously, the first guide element 66 of the second part 574 of the transmission arm 57 is at least one pin. Furthermore, the second guide element 67 of the drive arm 18 is a groove arranged in the drive arm 18.

Here, the or each guide element 66 is formed by a pin fastened on the second part 574 of the transmission arm 57. In this example and as illustrated in FIG. 10, the second part 574 of the transmission arm 57 comprises two pins 66. The second guide element 67 is formed by a groove arranged in the drive arm 18, preferably in the body 18*b* of the drive arm 18. The two pins 66 are configured to cooperate with the groove 67.

Thus, the second part 574 of the transmission arm 57 is moved in a translational movement relative to the drive arm 18 using the uncoupling of the first and second parts 572, 574 of the transmission arm 57 by the first and second gear segments 64, 65 and the positioning of the or each pin 66 of the second part 574 of the transmission arm 57 inside the groove 67 of the drive arm 18.

In this way, the second part 574 of the transmission arm 57 is kept at a constant height relative to the drive arm 18 and the pin 59 of the shuttle 58, during the movement of the shuttle 58 and, more particularly, during the electrical activation of the electromechanical actuator 6.

As a result, the uncoupling of the first and second parts 572, 574 of the transmission arm 57 and the positioning of the or each pin 66 of the second part 574 of the transmission arm 57 inside the groove 67 of the drive arm 18 make it possible to guarantee the coupling of the pin 59 of the shuttle 58 with the slot 60 of the transmission arm 57.

Furthermore, such a construction of the locking control device 26 makes it possible to guarantee a wider positioning allowance of the pin 59 of the shuttle 58 relative to the slot 60 of the transmission arm 57, so as to facilitate the installation of the motorized drive device 5.

Furthermore, the connection between the first and second parts 572, 574 of the transmission arm 57 using the first and second gear segments 64, 65 makes it possible to guarantee the rotational driving of the first part 572 of the transmission arm 57, about the rotation axis Y', of the toothed wheel 52 using the rack 61 of the transmission arm 57, then of the shaft 33 of the latch 21.

In a variant, not shown, the groove 67 is arranged in the cover 18*a* of the drive arm 18.

In a variant, not shown, a first pin 66 is configured to cooperate with a first groove 67 arranged in the body 18*b* of the drive arm 18. Furthermore, a second pin 66 is configured to cooperate with a second groove 67 arranged in the cover 18*a* of the drive arm 18.

The number of pins of the second part of the transmission arm is not limiting and can be different, in particular only one or greater than two.

Preferably, the first part 572 of the transmission arm 57 comprises the opening configured to cooperate with the shaft 56, so as to allow the rotation of the transmission arm 57 relative to the drive arm 18 about the rotation axis Y', as well as the rotation of the rack 61 configured to cooperate with the toothed wheel 52. Furthermore, the second part 574 of the transmission arm 57 comprises the slot 60 configured to cooperate with the pin 59 of the shuttle 58.

Thus, the drive element 47 is made in two parts 572, 574, the first part 572 of which is mounted rotatably relative to the drive arm 18, about a rotation axis Y'.

Advantageously, the first part 572 of the transmission arm 57 comprises at least one recess 68 configured to cooperate with the body 18*b* of the drive arm 18 and, more particularly, fastening zones 18*d*, 63 arranged in the body 18*b* of the drive arm 18, in the assembled configuration of the locking control device 26.

Here and non-limitingly, the first part 572 of the transmission arm 57 comprises two recesses 68.

Advantageously, the toothed wheel 52 comprises a cavity, not shown, for example a slot. Furthermore, the cavity of the toothed wheel 52 is accessible from the outside of the drive arm 18 and, in particular, following the disassembly of the cover 18*a* from the drive arm 18 and, optionally, the trim element.

Thus, the cavity of the toothed wheel 52 allows the user to control the locking control device 26 manually, in particular during an electrical power supply outage of the motorized drive device 5.

Here, the toothed wheel 52 can be rotated by means of a tool, for example a screwdriver, configured to cooperate with the cavity.

In a variant, not shown, the cavity arranged in the toothed wheel 52 can be configured to receive an element for viewing a state of the latch 21, in particular a locked state or an unlocked state, in the assembled configuration of the locking control device 26.

Furthermore, the element for viewing a state of the latch 21 can be removed from the cavity of the toothed wheel 52, so as to access the cavity of the toothed wheel 52 to make it possible to control the locking control device 26 manually.

We now describe a method for controlling the operation of the motorized drive device 5 of the sliding window 2 for a building according to one of the embodiments of the invention.

The method for controlling the operation of the motorized drive device 5 comprises, when the electromechanical actuator 6 is electrically activated, a step for activating the error-proofing system 27, then a step for activating the latch 21 using the locking control device 26.

Owing to the present invention, the arrangement formed by the motorized drive device, the fittings system and the locking control device of the sliding window makes it possible to simplify the industrialization of the locking control device, to guarantee tightness in a closed and locked position of the opening leaf relative to the stationary frame, while minimizing the costs of obtaining the window.

Many changes can be made to the example embodiment previously described without going beyond the scope of the invention defined by the claims.

In particular, the motorized drive device 5 can be configured to move several opening leaves 3*a*, 3*b* by sliding using the flexible element 9, in a same movement direction or in an opposite movement direction.

Furthermore, the considered embodiments and alternatives may be combined to generate new embodiments of the invention, without going beyond the scope of the invention defined by the claims.

The invention claimed is:

1. A sliding window for a building, the sliding window comprising:

a stationary frame, at least one opening leaf, a motorized drive device for moving the opening leaf by sliding relative to the stationary frame, the motorized drive device comprising:

an electromechanical actuator, the electromechanical actuator comprising an electric motor, a flexible element, the flexible element being configured to drive a movement of the opening leaf relative to the stationary frame, when the electromechanical actuator is electrically activated, a drive arm, the drive arm being connected to a frame of the opening leaf and to the flexible element, a fittings system, the fittings system comprising a latch, a locking control device, the locking control device being configured to:

cooperate with the latch, and be actuated using the flexible element, when the electromechanical actuator is electrically activated, wherein the drive arm supports the locking control device, wherein the fittings system also comprises an error-proofing system and a window catch, wherein the error-proofing system comprises a retractable pin, the retractable pin being configured to be moved between an idle position, in which the window catch is blocked, and an activated position, in which the window catch is released, wherein the error-proofing system is activated when the retractable pin is pushed inside a housing arranged in the frame of the opening leaf, and wherein the locking control device is configured to actuate the latch, after the activation of the error-proofing system and when the electromechanical actuator is electrically activated.

2. The sliding window for a building according to claim 1, wherein the locking control device comprises an actuating mechanism of the latch configured to rotate a shaft of the latch, during driving of the flexible element by the electromechanical actuator.

3. The sliding window for a building according to claim 2, wherein the actuating mechanism of the latch comprises at least one lever arm.

4. The sliding window for a building according to claim 3, wherein the locking control device comprises a transmission element connected to the shaft of the latch.

5. The sliding window for a building according to claim 2, wherein the actuating mechanism of the latch comprises an additional flexible element.

6. The sliding window for a building according to claim 5, wherein the locking control device comprises a transmission element connected to the shaft of the latch.

7. The sliding window for a building according to claim 2, wherein the actuating mechanism of the latch comprises a gear.

8. The sliding window for a building according to claim 7, wherein the locking control device comprises a transmission element connected to the shaft of the latch.

9. The sliding window for a building according to claim 2, wherein the locking control device comprises a transmission element connected to the shaft of the latch.

10. The sliding window for a building according to claim 2, wherein the drive arm is stationary relative to the frame of the opening leaf.

11. The sliding window for a building according to claim 1, wherein the drive arm is stationary relative to the frame of the opening leaf.

12. The sliding window for a building according to claim 1, wherein the drive arm and the latch of the fittings system are arranged in an upper part of the lateral upright of the frame of the opening leaf, in the assembled configuration of the window relative to the building.

13. The sliding window for a building according to claim 1, wherein the locking control device comprises a drive element, wherein the drive element is connected to the flexible element and wherein at least part of the drive element is mounted rotatably relative to the drive arm, around a rotation axis.

14. The sliding window for a building according to claim 13, wherein the drive element comprises a transmission arm and wherein the transmission arm comprises an end with a rack.

15. The sliding window for a building according to claim 14, wherein the connection of the flexible element to the drive element is done using a shuttle and wherein the shuttle comprises a pin configured to cooperate with a slot of the transmission arm.

16. The sliding window for a building according to claim 14, wherein the locking control device comprises an actuating mechanism of the latch configured to rotate a shaft of the latch, during driving of the flexible element by the electromechanical actuator, wherein the locking control device comprises a transmission element connected to the shaft of the latch, wherein the transmission element and the drive element are an integral part of the actuating mechanism of the latch, wherein the transmission element is a toothed wheel, wherein the toothed wheel is configured to be assembled on the shaft of the latch and wherein the rack of the transmission arm is configured to cooperate with the toothed wheel, in an assembled configuration of the locking control device.

17. The sliding window for a building according to claim 13, wherein the drive element comprises a first part and a second part, wherein the first part of the drive element comprises a first gear segment configured to cooperate with a second gear segment of the second part of the drive element, in an assembled configuration of the locking control device, and wherein the second part of the drive element comprises at least a first guide element configured to cooperate with a second guide element provided on the drive arm.

18. The sliding window for a building according to claim 1, wherein the electromechanical actuator is reversible.

19. A home automation facility comprising the sliding window according to claim 1.

20. A method for controlling operation of a motorized drive device of a sliding window for a building, the sliding window comprising:

a stationary frame, at least one opening leaf, a motorized drive device for moving the opening leaf by sliding relative to the stationary frame, the motorized drive device comprising:

an electromechanical actuator, the electromechanical actuator comprising an electric motor, a flexible element, the flexible element being moved by the electromechanical actuator, the flexible element being configured to drive a movement of the opening leaf relative to the stationary frame, when the electromechanical actuator is electrically activated, a drive arm, the drive arm being connected to a frame of the opening leaf and to the flexible element, a fittings system, the fittings system comprising a latch, a locking control device, the locking control device being configured to:

cooperate with the latch, and be actuated using the flexible element, when the electromechanical actuator is electrically activated, wherein:

the drive arm supports the locking control device, the fittings system also comprises an error-proofing system and a window catch, the error-proofing system comprises a retractable pin, the retractable pin being configured to be moved between an idle position, in which the window catch is blocked, and an activated position, in which the window catch is released, the error-proofing system is activated when the retractable pin is pushed inside a housing arranged in the frame of the opening leaf, and wherein the method comprises at least the following steps, carried out during the electrical activation of the electromechanical actuator:

activation of the error-proofing system, then activation of the latch using the locking control device.

* * * * *